US008152647B2

(12) United States Patent
Tuckey et al.

(10) Patent No.: US 8,152,647 B2
(45) Date of Patent: Apr. 10, 2012

(54) LIFT OFF CHILD SWING WITH RECLINE AND SWIVEL

(75) Inventors: Peter R. Tuckey, Morgantown, PA (US); Curtis M. Hartenstine, Birdsboro, PA (US); Sharon A. Gillett, Shillington, PA (US)

(73) Assignee: Wonderland Nurserygoods Co., Ltd, Taipei (TW)

( * ) Notice: Subject to any disclaimer, the term of this patent is extended or adjusted under 35 U.S.C. 154(b) by 535 days.

(21) Appl. No.: 11/778,438

(22) Filed: Jul. 16, 2007

(65) Prior Publication Data

US 2008/0020854 A1 Jan. 24, 2008

Related U.S. Application Data

(60) Provisional application No. 60/831,833, filed on Jul. 19, 2006, provisional application No. 60/856,768, filed on Nov. 3, 2006, provisional application No. 60/875,248, filed on Dec. 15, 2006.

(51) Int. Cl.
*A63G 9/00* (2006.01)

(52) U.S. Cl. ..... 472/118; 472/119; 297/256.12; 297/256.13

(58) Field of Classification Search ..... 472/118, 472/119; 297/256.12, 256.13, 256.16
See application file for complete search history.

(56) References Cited

U.S. PATENT DOCUMENTS

| | | | | | |
|---|---|---|---|---|---|
| 5,335,964 | A | | 8/1994 | Sedlack | 297/256.13 |
| 5,494,331 | A | | 2/1996 | Onishi | 297/256.13 |
| 5,562,548 | A | * | 10/1996 | Pinch et al. | 472/119 |
| 5,697,756 | A | * | 12/1997 | Wheaton | 414/680 |
| 5,746,478 | A | | 5/1998 | Lumley | 297/256.13 |
| 6,017,088 | A | | 1/2000 | Stephens | 297/256.16 |
| 7,073,859 | B1 | * | 7/2006 | Wilson | 297/256.1 |

* cited by examiner

*Primary Examiner* — Gene Kim
*Assistant Examiner* — Michael Dennis
(74) *Attorney, Agent, or Firm* — Miller Law Group, PLLC

(57) ABSTRACT

An infant swing has a base member supported by hanger members for reciprocal movement. A seat that can be utilized in other applications is detachably mounted on and latched to the base member, which is formed with a swivel mechanism that allows the seat to be selectively positioned in a back-and-forth swing configuration or a sideways swing configuration. The swivel mechanism utilizes a triangular guide that engages an elliptical retainer to cause a lateral shift in the center of gravity of the seat when re-positioned. The base member also incorporates a recline mechanism that can be actuated with one hand. The recline actuation mechanism uses a self-centering push bar that is formed with protrusions engaged with slotted channels to lock the seat in a selected recline position. The push bar is operable to either transverse direction to release the protrusions from the slotted channels for selecting the new recline position.

27 Claims, 18 Drawing Sheets

Fig. 8
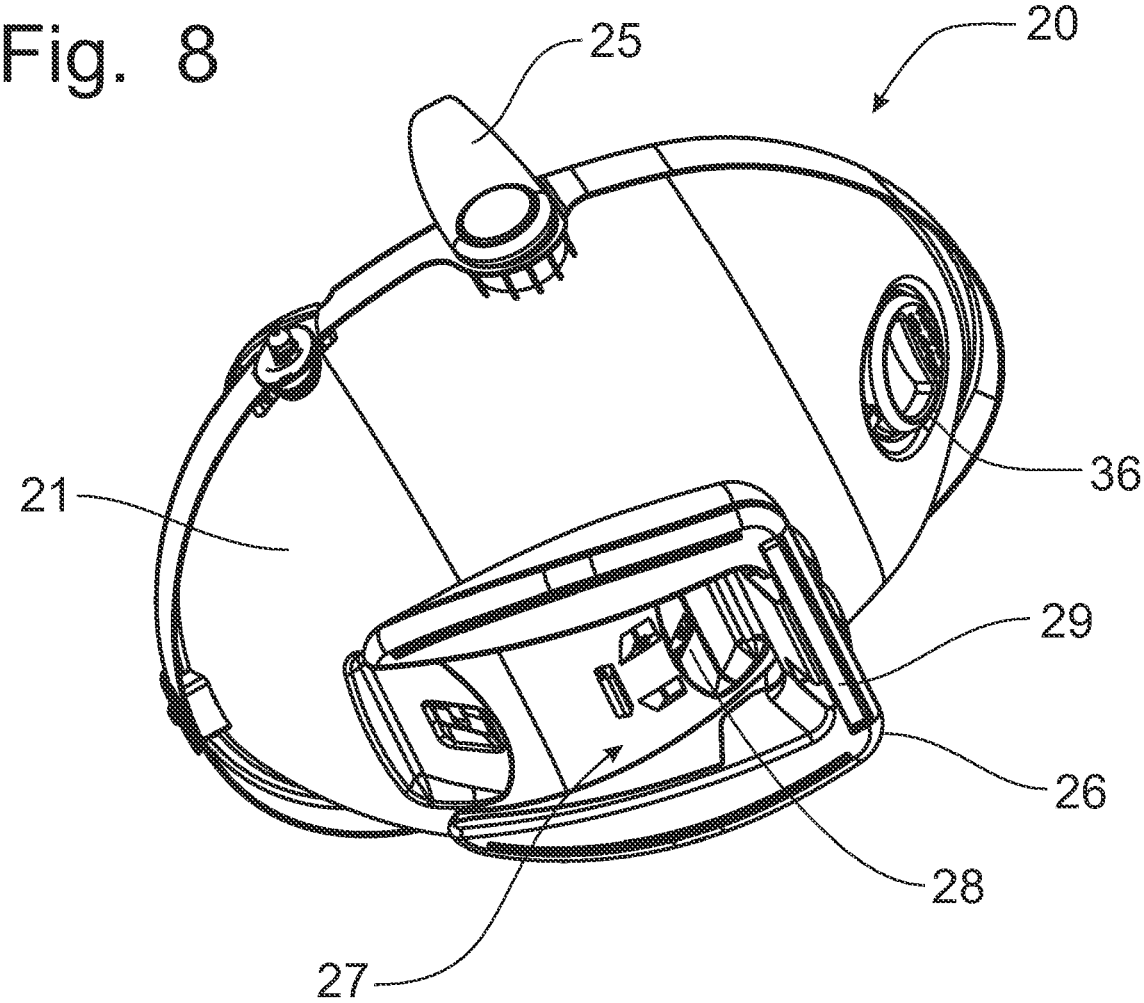
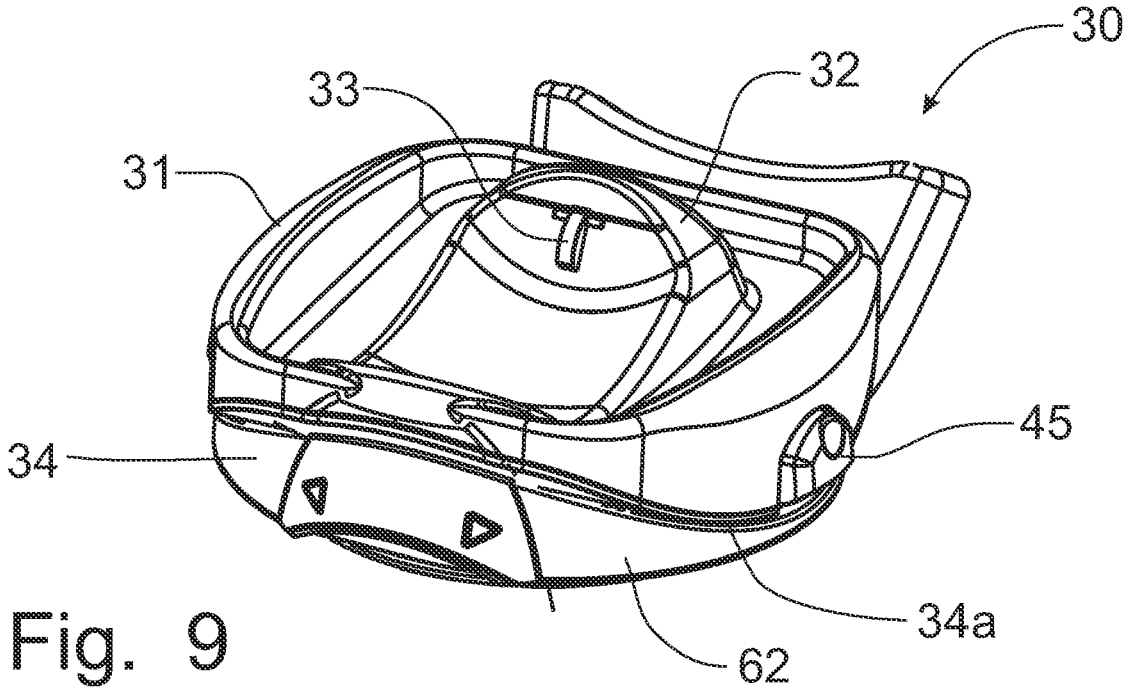
Fig. 9

Fig. 14
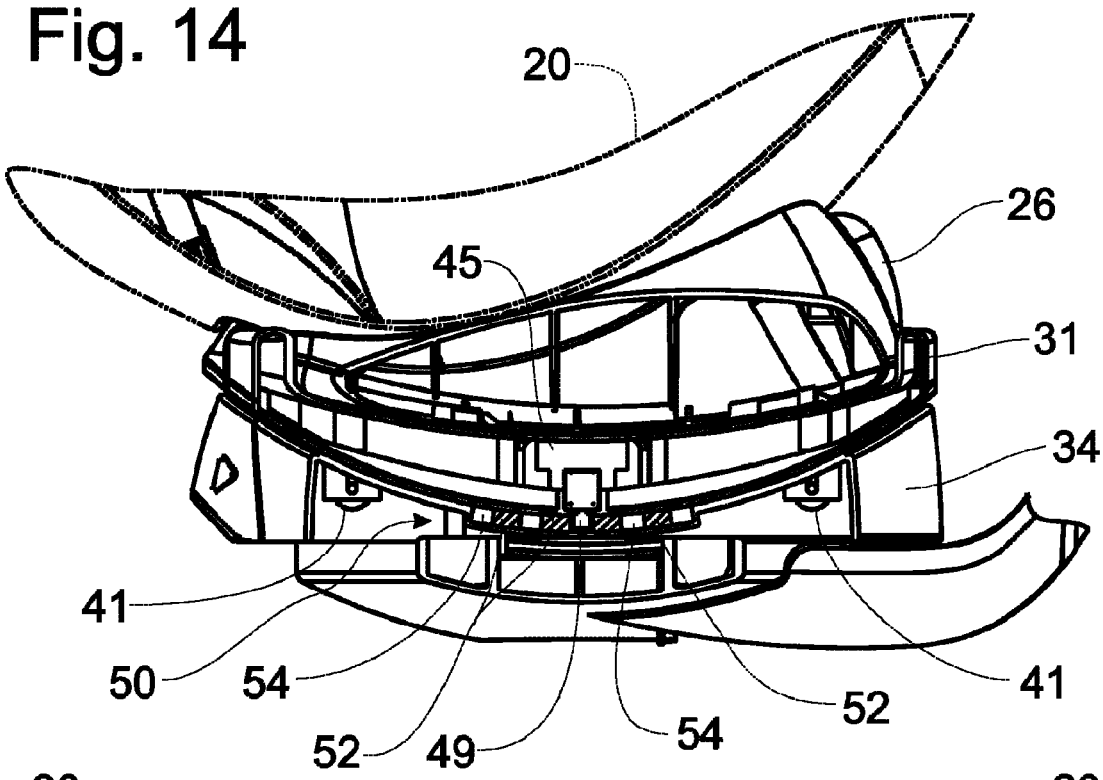
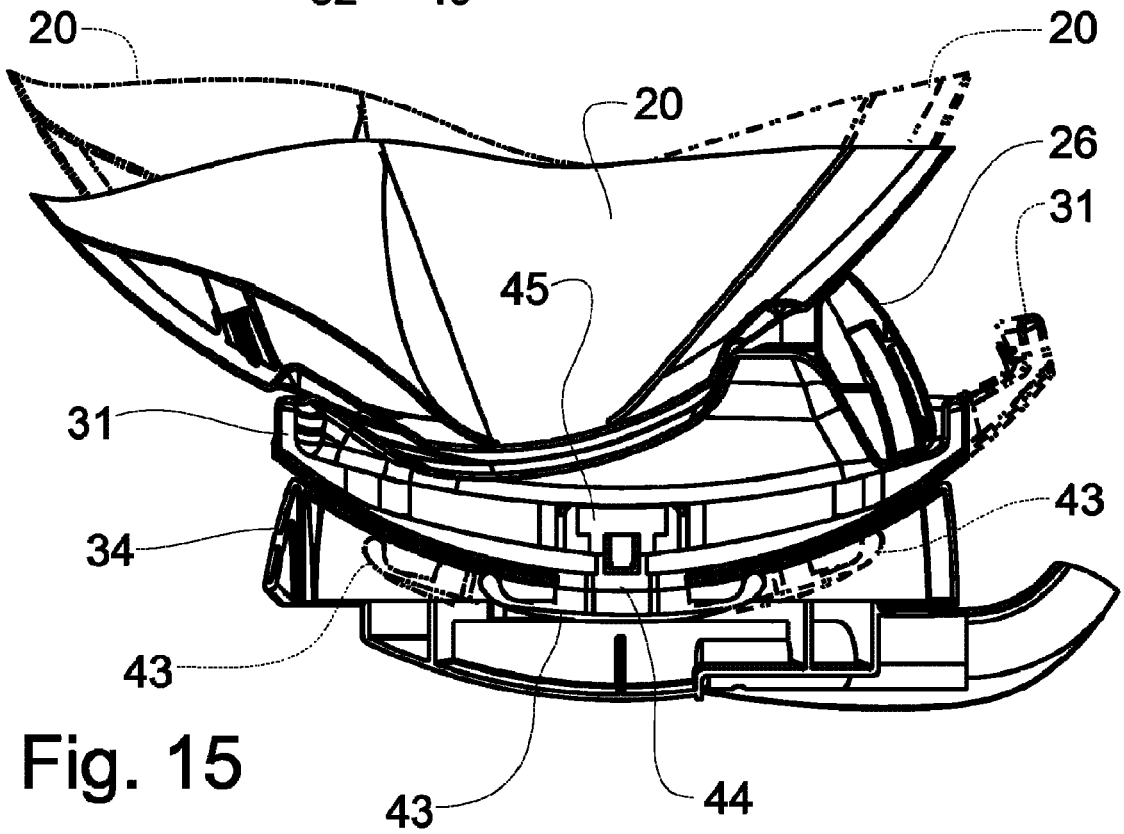
Fig. 15

LIFT OFF CHILD SWING WITH RECLINE AND SWIVEL

CROSS-REFERENCE TO RELATED APPLICATIONS

This application claims priority on U.S. Provisional Patent Application Ser. No. 60/831,833, filed on Jul. 19, 2006; on U.S. Provisional Patent Application Ser. No. 60/856,768, filed on Nov. 3, 2006; and on U.S. Provisional Patent Application Ser. No. 60/875,248, filed on Dec. 15, 2006; the contents of all three of these provisional patent applications being incorporated herein by reference.

FIELD OF THE INVENTION

The present invention relates generally to a frame for an infant swing and, more particularly, to a hanger mount structure that provides convenient utilization while ensuring that the electric motor is operable to transmit torque to the hanger members to affect reciprocal movement thereof.

BACKGROUND OF THE INVENTION

Baby swings are used extensively by infant caregivers to soothe and to comfort the children. An infant swing consists primarily of a seat that securely holds the infant in a position elevated off the floor and a frame apparatus that supports the seat and allows the seat to move in a reciprocal manner, typically in a forward and rearward direction though some infant seats provide a side to side swinging motion. Such swings provide a comfortable, safe and entertaining environment to the child.

When caring for an infant, it is extremely advantageous to be able to provide an environment that minimally disturbs the infant when they are resting or sleeping. The necessity to physically move an infant out of one seat and place them in another seat is usually agitating to the infant. Additionally, having the versatility to be able to provide a swinging motion to the specific seat an infant is occupying is also valuable. Therefore, having a swing that would allow either a carrier or a car seat to be directly attached to it would provide the caregiver with the option of being able to provide a swinging motion to the infant without moving the infant from one seat to the other. One such convertible swing system can be found in U.S. Pat. No. 6,017,088, issued on Jan. 25, 2000, to William Stephens, et al, in which a seat member is detachably mounted on a base member through a locking mechanism.

Accordingly, it would be advantageous to provide a mechanical interface connection on a swing hanger system to which either a car seat or baby carrier can be attached. This mechanical interface connection allows the caregiver to directly attach either a car seat, or an infant carrier to the hanger system to transfer a sleeping child from one support system to a swing system.

The majority of swing seats commercially available achieve back recline adjustment using a support wire retained by molded slots on the back of the seat and engagable with slotted stops. The support wire is most often pivotally connected to the hanger tubes. The seat in such systems is designed such that recline movement pivots around a hinged connection with the seat bottom. This form of recline mechanism has proven to be both cost effective and structurally sound; however, such recline mechanism requires the caregiver to use two hands while standing behind the swing when adjusting the seat back angle. One hand is needed to support the seat back while the other hand repositions the wire.

Although effective, this type of recline mechanism is lacking in accommodating ergonomic and intuitive interaction.

U.S. Pat. No. 5,746,478, granted on May 5, 1998, to Michael Lumley, et al discloses a recline mechanism for a child safety seat in which the latch mechanism accessible from the front of the child safety seat operates a latch element that is engagable with a pair of laterally spaced racks having openings in the top surface thereof to receive the engaged latch elements. In U.S. Pat. No. 5,494,331, issued to Ichiro Onishi, et al on Feb. 27, 1996, a child safety seat can be reclined relative to a base member through arcuate tracks that are latched together by a spring-loaded latch pin. The automotive infant restraint seat in U.S. Pat. No. 5,335,964, granted to Mark Sedlack, et al on Aug. 9, 1994, incorporates a post that is selectively engagable with catches to establish the reclined position of the seat member relative to a base member supporting the seat.

Accordingly, it would be desirable to provide a recline mechanism for a swing system that could be actuated with a single hand. It would further be desirable to provide a recline mechanism that would be housed within the hanger system on which a removable seat member can be detachably mounted.

Many caregivers prefer the option of both a front to back and sideways swing motion because it allows them to customize the ride to their child's preference. Providing a swivel motion for a swing seat allows the caregiver to position the seat in longitudinal or transverse orientations to allow the swing to provide optional swing directions. One such swing is found in U.S. Pat. No. 5,562,548, granted to Daniel Pinch, et al on Oct. 8, 1996, wherein the swivel component is located underneath the seat. The swivel component consists of a platform around which the seat can rotate about a vertical pivot axis. The placement of the swivel mechanism under the swing seat allows clearance above the child's head for placing the child in and out of the seat. In a pendulum form of a child's swing, the seat and base is suspended from a mechanism supported above the child's seat. This mechanism can incorporate a swivel connection so that the seat can be positioned for a front to back swing or re-oriented to provide a sideways swinging motion. Such a swing can provide the two desirable different swinging motions but this mechanism located above the child's seat may obstruct accessibility to the child in the swing seat, especially when taking the child in and out of the seat.

A very significant design consideration for an infant swing is the location of the center of gravity of a child, which may not necessarily pass through the geometric center of the seat. Accordingly, if a swing seat is rotated around a pivot axis located essentially at the center of gravity when changing the swing motion from a forward swinging position to a side to side swinging position, the seat geometry will not be centered in the swing frame when the swing is in the side to side swing position. Therefore, it would be highly advantageous if the seat could be both rotated from a forward to side to side position, and also be transversely moved in order to better center the swing seat within the swing frame when in the side to side position.

Accordingly, it would be desirable to provide a swivel mechanism for a seat apparatus mounted on a base member that is operable to transversely shift the seat member with the child seated therein laterally when the seat is moved from the back-and-forth swing orientation to a sideways swing orientation.

SUMMARY OF THE INVENTION

It is an object of this invention to provide an infant swing that overcomes the aforementioned disadvantages of the prior art.

It is another object of this invention to provide an infant swing that includes a base member adapted to detachably receive a seat member that can be used in multiple configurations.

It is a feature of this invention that the infant swing incorporates a locking mechanism that can be actuated with one hand to affect a removal of the seat from the base member.

It is another feature of this invention that the mating configurations of the seat and the base member include a spring-loaded latch member in the base member that is receivable within a latch opening in the seat to secure the seat to the base member.

It is still another feature of this invention that the seat is formed with a pivoted actuator that is connected to an external pull member to force the spring-loaded latch member out of the latch opening when the seat is to be removed from the base member.

It is an advantage of this invention that the seat can be latched to the base member simply by sitting the seat member on top of the base member with the latch member aligned with the latch opening.

It is another advantage of this invention that the seat can be easily removed from the base member by simply pulling the release pull member to force the latch member out of engagement with the seat.

It is still another object of this invention to provide a swivel mechanism for a detachable seat mounted on a base member supported on the hanger members of an infant swing.

It is yet another object of this invention to provide a swivel mechanism that is operable to laterally shift the center of gravity of the seat and supported child when the seat is moved from a back-and-forth swing configuration to a sideways swing configuration.

It is yet another feature of this invention that the swivel mechanism for the infant swing does not pivot about a fixed axis of rotation.

It is still another feature of this invention that the swivel mechanism utilizes an elliptical retainer engagable with a triangular guide to control the rotational movement of the seat relative to the base member of the infant swing.

It is still another advantage of this invention that the rotational movement of the seat relative to the base member affects a lateral shift of the center of gravity of the seat and occupant.

It is yet another feature of this invention that the movement of the seat from a back-and-forth swing configuration to a sideways swing configuration keeps the center of gravity of the seat and occupant proximate to the longitudinal centerline of the infant swing.

It is yet another advantage of this invention that the swing is not unbalanced when the seat is moved from a back-and-forth swing configuration to a sideways swing configuration.

It is still another feature of this invention that the swivel mechanism is housed within the base member of the infant swing.

It is still another advantage of this invention that the space above the seat is not cluttered by an overhead swivel mechanism that could interfere with access to the child within the seat structure.

It is a further object of this invention to provide a recline mechanism that can be operated by a single hand to select the recline position of a seat detachably mounted to a base member of an infant swing.

It is a further feature of this invention that the recline actuation mechanism includes a self-centering push bar that when manipulated frees the seat for recline positioning relative to the base member.

It is still a further object of this invention that the push bar is formed with protrusions that are positionable in an interfering position with corresponding slotted channels to lock the seat in the selected recline position relative to the base member.

It is a further advantage of this invention that the self-centering push bar is operable in either transverse direction to release the protrusions from the slotted channels to free the seat for selecting a recline position.

It is still a further advantage of this invention that the recline actuation mechanism can be operated with a single hand.

It is yet a further advantage of this invention that the recline actuation mechanism is housed within the base member of the infant swing.

It is still a further object of this invention to provide an infant swing incorporating a lift-off seat that is capable of being positioned in multiple swing orientations and of being moved into a selected recline position, which is durable in construction, inexpensive of manufacture, carefree of maintenance, facile in assemblage, and simple and effective in use.

These and other objects, features and advantages are accomplished according to the instant invention by providing an infant swing having a base member supported by hanger members for reciprocal movement. A seat that can be utilized in other applications is detachably mounted on and latched to the base member, which is formed with a swivel mechanism that allows the seat to be selectively positioned in a back-and-forth swing configuration or a sideways swing configuration. The swivel mechanism utilizes a triangular guide that engages an elliptical retainer to cause a lateral shift in the center of gravity of the seat when re-positioned. The base member also incorporates a recline mechanism that can be actuated with one hand. The recline actuation mechanism uses a self-centering push bar that is formed with protrusions engaged with slotted channels to lock the seat in a selected recline position. The push bar is operable to either transverse direction to release the protrusions from the slotted channels for selecting the new recline position.

BRIEF DESCRIPTION OF THE DRAWINGS

The advantages of this invention will be apparent upon consideration of the following detailed disclosure of the invention, especially when taken in conjunction with the accompanying drawings wherein:

FIG. 8 is bottom, side perspective view of the seat carrier to depict the mounting structure of the seat carrier for engagement with the base member;

FIG. 9 is a top, side perspective view of the base member to depict the mounting structure of the base member for engagement with the seat carrier;

FIG. 14 is a cross-sectional view of the base member taken along lines 14-14 of FIG. 4 to depict the slotted channels that lock the seat carrier in a selected recline position, a portion of the seat carrier being shown in phantom;

FIG. 15 is a cross-sectional view of the base member taken along lines 15-15 of FIG. 4 to show the mounting plate for the seat member to permit selective recline positioning thereof, the movement of the seat carrier and attached top plate being shown in phantom to either side of the centered position shown in solid lines;

DETAILED DESCRIPTION OF THE PREFERRED EMBODIMENT

Figure 1:
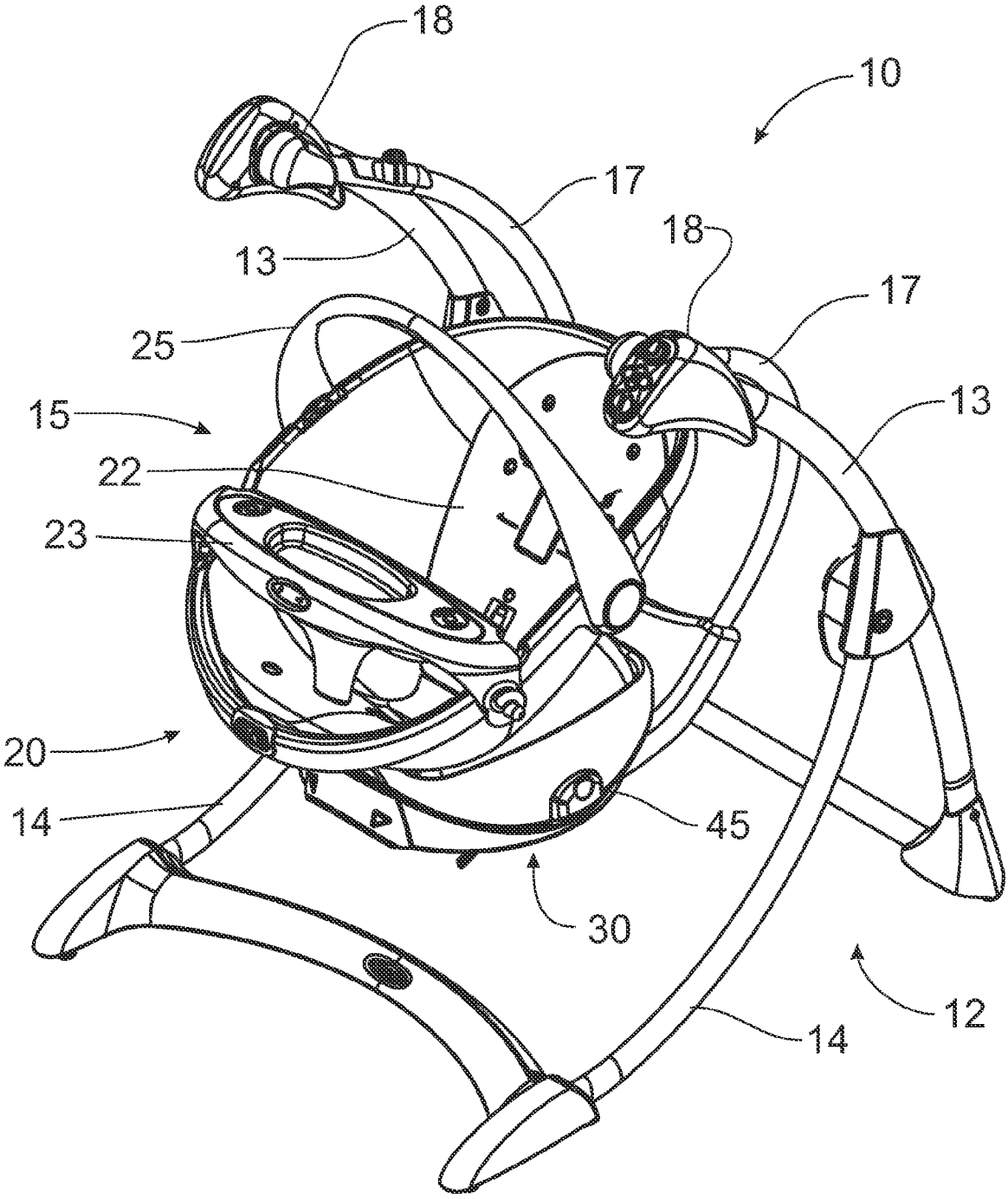
FIG. 1 is a upper front perspective view of the infant swing incorporating the principles of the instant invention.

Referring now to the drawings, an infant swing incorporating the principles of the instant invention can best be seen. The infant swing 10, as can best be seen in FIGS. 1-3, includes as the major components thereof a support frame assembly 12, including a pair of transversely spaced rear legs 13 and a corresponding pair of front legs 14, and a seat assembly 15 suspended from the frame assembly 12 for a fore-and-aft swinging movement. As will be described in greater detail below, the seat assembly 15 is formed of a molded seat carrier 20 mounted on a base member 30 affixed to a pair of transversely spaced hangers 17 that are connected to corresponding hanger housings 18 positioned at the cantilevered ends of the rear legs 13.

Referring now to FIGS. 4-12, the seat carrier 20 is configured to be used in multiple applications, such as a car seat or a stroller, in addition to being used in the infant swing assembly 10 as will be described in detail below. The seat carrier 20 is formed with an exterior shell 21 supporting a seat 22 onto which an infant is supported and restrained. The exterior shell 21 has a removable tray 23 mounted at a forward position and defining a yoke 24 that prevents an infant from sliding forwardly out of the seat 22. The exterior shell is also provided with a pivoted lift handle 25 that is movable between an upright position, shown in FIGS. 4 and 5, and a folded or retracted position which is shown in phantom in FIG. 5.

As is best seen in FIGS. 8 and 9, the underside of the exterior shell 21 is formed with mounting structure 26 that is engagable with the base member 30. The mounting structure 26 includes a receptacle 27 that is formed to receive the mounting protrusion 32 of the base member 30 so that the seat carrier 20 is not horizontally movable relative to the base member 30. The receptacle 27 includes a latch opening 28 into which the latch member 33, biased by the spring members 33*a* to project outwardly from the receptacle 27 and pivotally mounted on the base member mounting protrusion 32, can pass to secure the seat carrier 20 on the base member 30 against vertical movement of the seat carrier 20. The mounting structure 26 is also preferably formed with an arcuate lower surface that allows the seat carrier 20 to be supported on a flat surface and be rocked. To negate this rocking motion, the mounting structure 26 can be provided with an extendable brace 29 that can selectively extend out of the back side of the mounting structure 26 to provide a stable, non-rocking support surface for the free-standing seat carrier 20.

Figure 10:
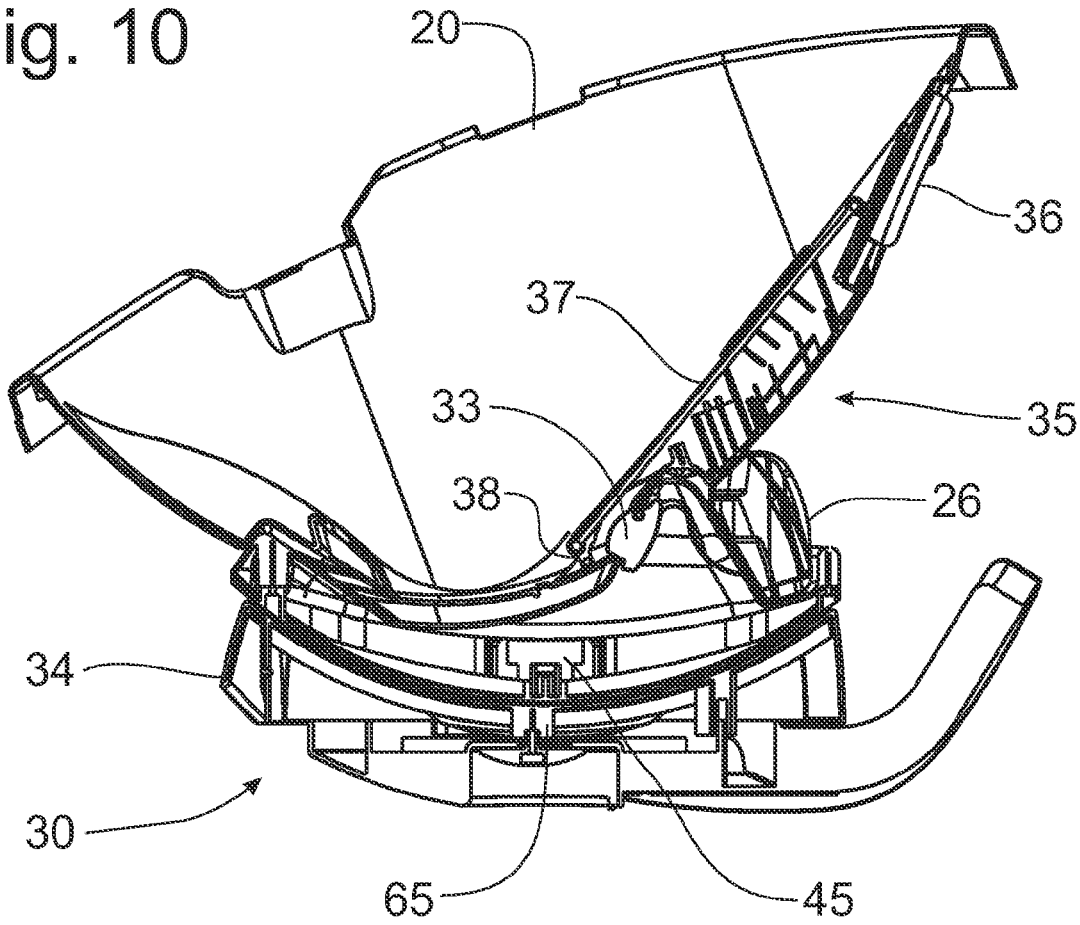
FIG. 10 is a cross-sectional view of the seat carrier mounted on the base member to show the latching mechanism for detachably securing the seat carrier on the base member.
Figures 11, 12:
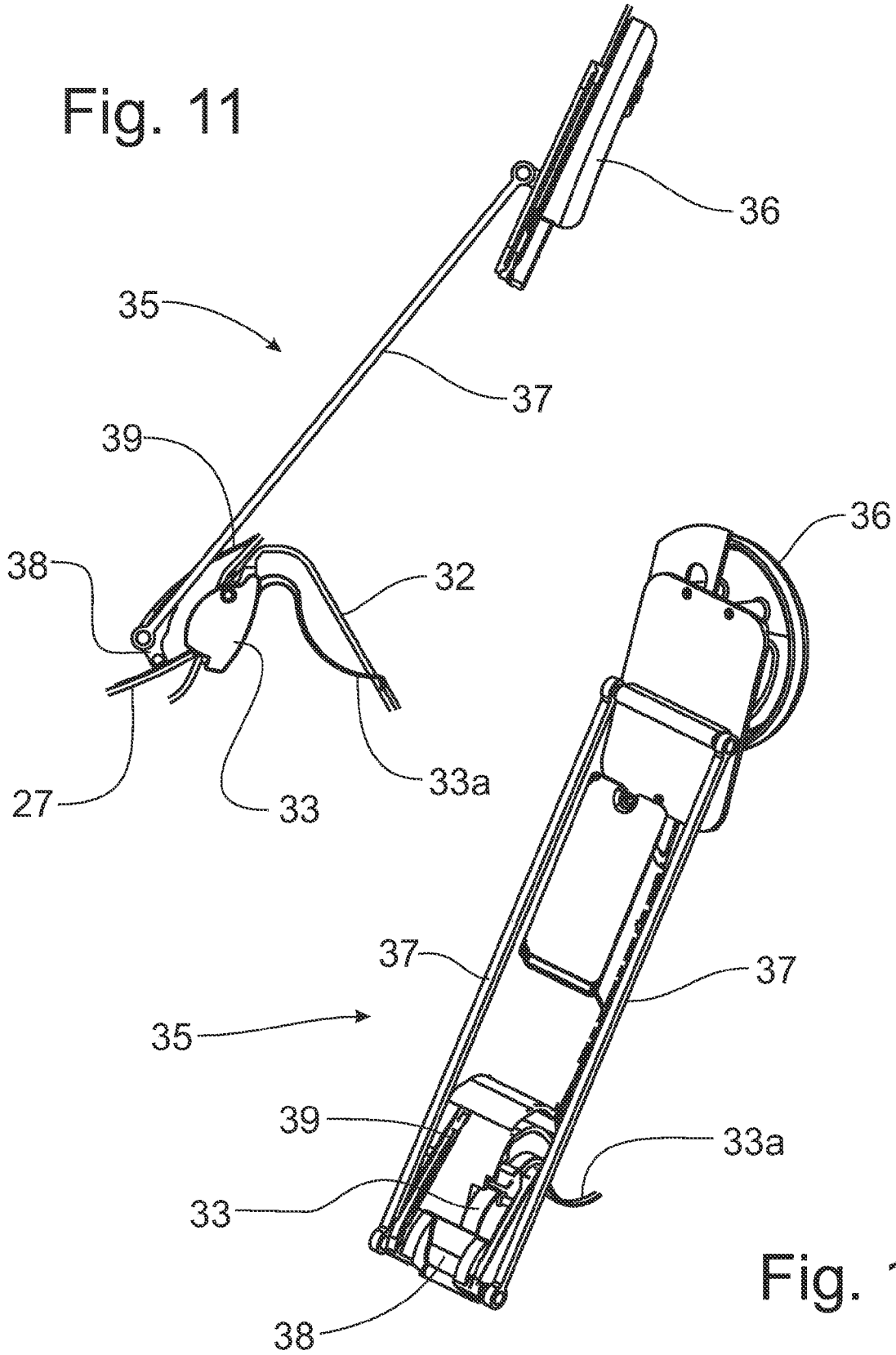
FIG. 11 is an enlarged elevational detail view of the latch linkage for securing the seat carrier on the base member.
FIG. 12 is an enlarged perspective detail view of the latch linkage shown in FIG. 11.
Figure 13:
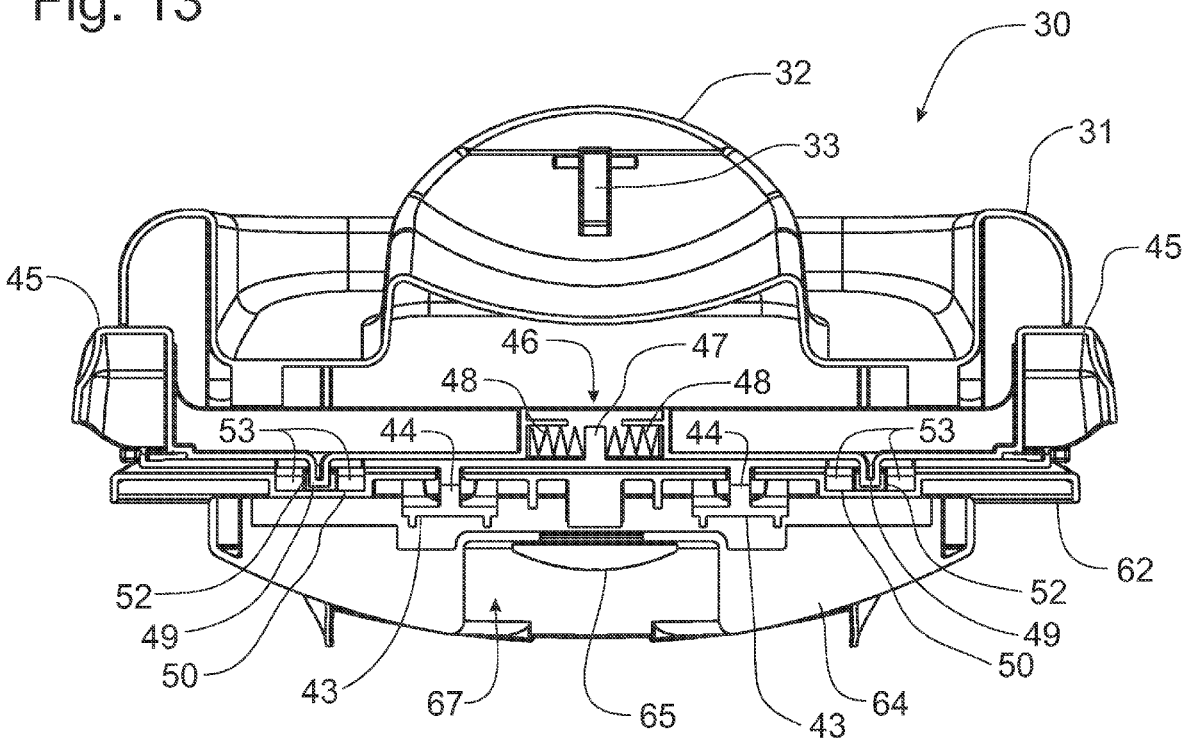
FIG. 13 is an enlarged cross-sectional view of the base member taken along lines 13-13 of FIG. 7 to depict the recline actuation mechanism.

The seat carrier 20 includes a latch actuation mechanism 35, best seen in FIGS. 10-12, operable to cause a pivotal movement of the latch member 33 to release the seat carrier 20 for vertical movement relative to the base member 30 and allow the seat carrier 20 to be lifted off the swing 10 and be removed therefrom. The latch actuation mechanism 35 includes an external pull member 36 that is connected via a pair of transversely spaced links 37 to a spring-loaded actuator 38 pivotally mounted to the exterior shell 21. When the latch member 33 snaps into the latch opening 28, the latch member 33 presses against the actuator 38. Pulling on the external pull member 36 causes a pivotal movement of the actuator 38 against the bias exerted thereon by the spring members 39 to push the latch member 33 out of the latch opening 28 and allow the seat carrier 20 to be lifted off of the base member 30.

Referring now to FIGS. 13-16, one of ordinary skill in the art will note that the recline mechanism 40 is housed within the base member 30. The base member 30 is formed with a lower, fixed base shell 34 that is secured to the hanger members 17 and movable therewith. A top plate 31, which includes the mounting protrusion 32, is movably mounted on the fixed base shell 34 and slidable along an arcuate track 34*a*. As can be seen best in FIG. 16, the top plate 31 is supported on rollers 41 that project upwardly through the upper face 63 of the base shell 34 to facilitate the sliding movement of the top plate 31 relative to the base shell 34. The base shell 34 is formed with longitudinally extending slots 42 through which the mounting tab 44 of slide retainers 43 extend so that the top plate 31 can be secured to the slide retainers 43 which run under the upper face 63 of the fixed shell 34. With this structure, the top plate 31 is free to move along the arcuate track 34*a* without being separable from the fixed shell 34. The slide retainers 43 prevent the top plate 31 from separating from the fixed base shell 34 without hindering the sliding movement thereof, while the rollers 41 minimize any friction between the top plate 31 and the base shell 34.

The recline mechanism 40 further includes a push/pull actuator handle 45 that spans transversely across the base member 30 to project outboard thereof on both sides of the base member 30. The actuator handle 45 is carried by the top plate 31 and includes a center chamber 46 having a bottom opening therein to receive a center post 47 formed in the top plate 31. The center chamber 46 carries a pair of springs 48 positioned on opposing sides of the center post 47 to center the actuator handle 45 on the top plate 31 and bias the actuator handle 45 to a centered position. The actuator handle 45 also is formed with a pair of downwardly extending protrusions 49 that are engagable, respectively, with corresponding formed locking channels 50.

Figure 16:
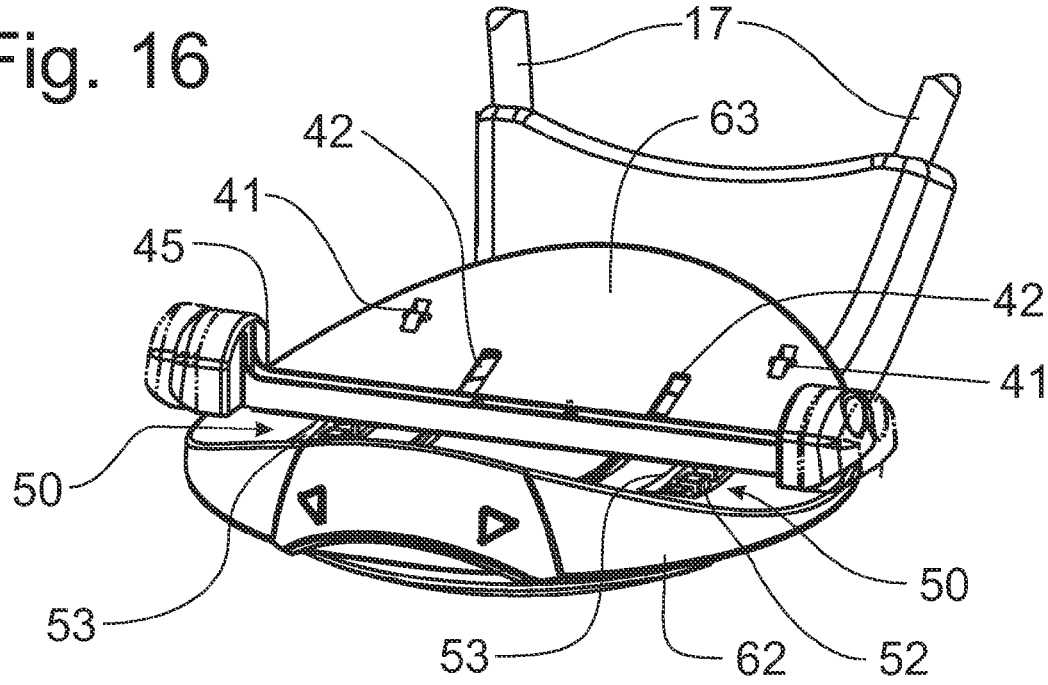
FIG. 16 is a perspective view of the base member with the top plate broken away to show the actuator handle and the slotted channels in the fixed base member, movement of the actuator handle being depicted in phantom.

Each locking channel 50 is formed as a depression into the face 63 of the base shell 34 so that the protrusions 49 are received therein. Each locking channel 50 is formed with a series of longitudinally spaced blocks 52, as is best seen in FIGS. 14 and 16, with a longitudinal passageway 53 located on the transversely opposing sides of the blocks 52, which in turn are separated by transversely extending grooves 54 that interconnect the transversely spaced passageways 53. When the actuator handle 45 is in the centered position, the protrusions are located within the transverse grooves 54 between selected blocks 52. Pushing the actuator handle 45 to either side against the biasing force exerted by the corresponding centering spring 48 causes the protrusions 49 to move sideways into the corresponding longitudinal passageway 53. The top plate 31 is then free to move along the arcuate track 34*a* relative to the base shell 34 within the parameters defined by the longitudinal passageways 53.

When the caregiver has selected the desired reclined position, the actuator handle 45 is allowed to return to the centered position which will then position the protrusions 49 within the transverse grooves 54 between the blocks 52. The blocks 52 serve to prevent longitudinal movement of the protrusions 49 and, thus, movement of the top plate 31 relative to the base shell 34. Preferably, several blocks 52 are utilized in the locking channels 50 so that at least five recline positions are defined by the transverse grooves 54. One skilled in the art will recognize that other numbers of transverse grooves 54, and the corresponding recline positions, can be defined by a selected number of blocks 52 within the depressed locking channel 50.

Figure 2:
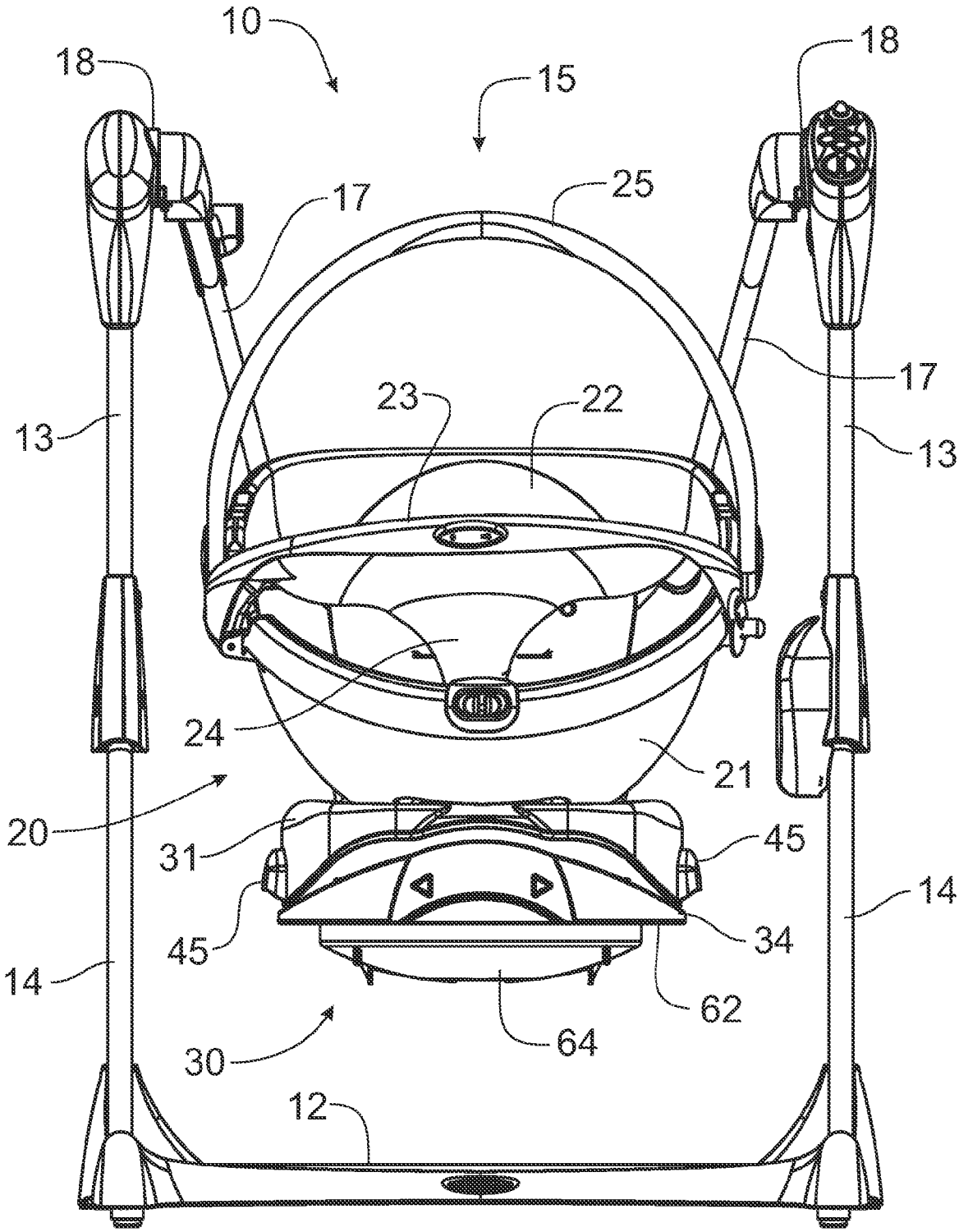
FIG. 2 is a front elevational view of the infant swing depicted in FIG. 1.
Figure 3:
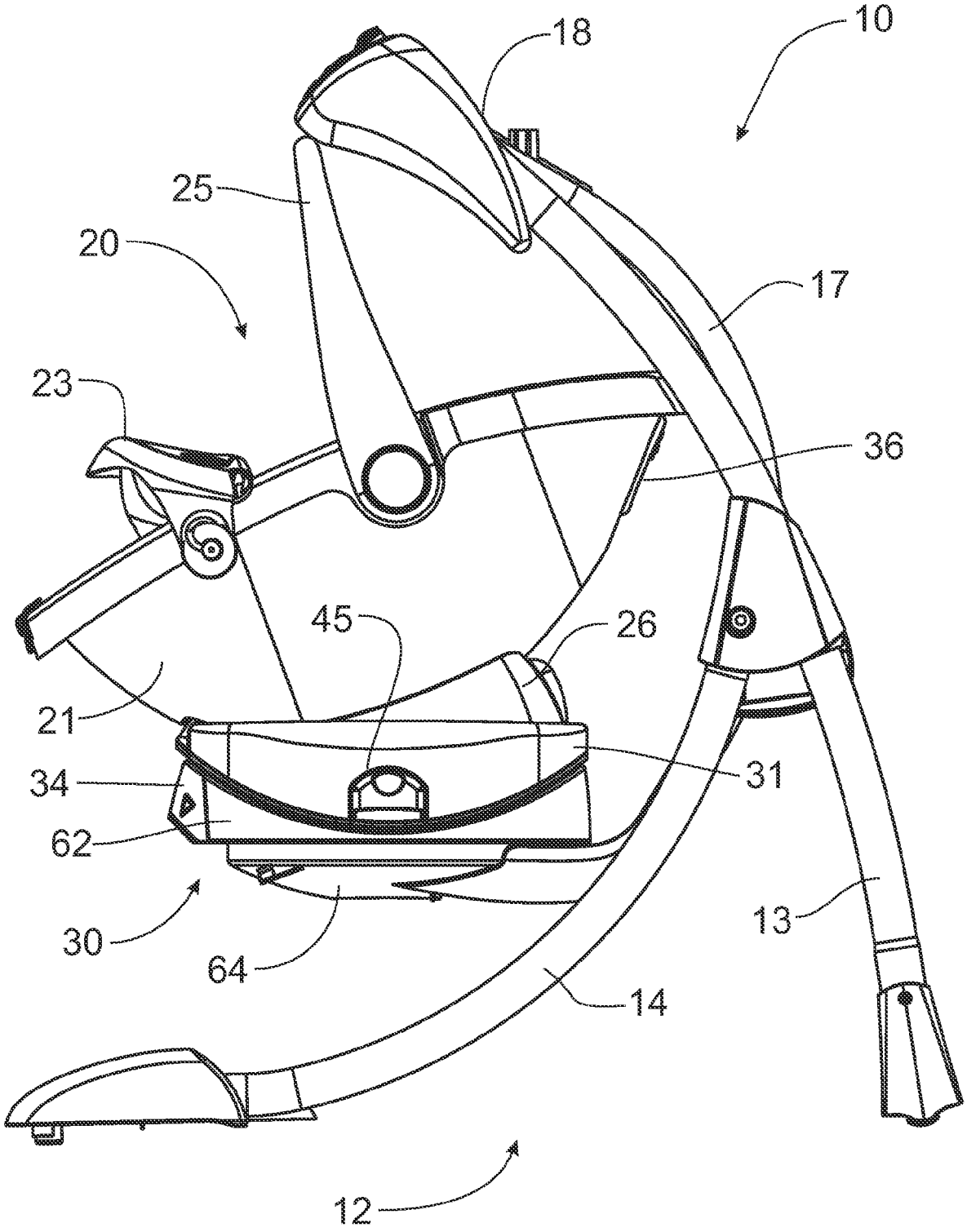
FIG. 3 is a left side elevational view of the infant swing shown in FIGS. 1 and 2.
Figure 4:
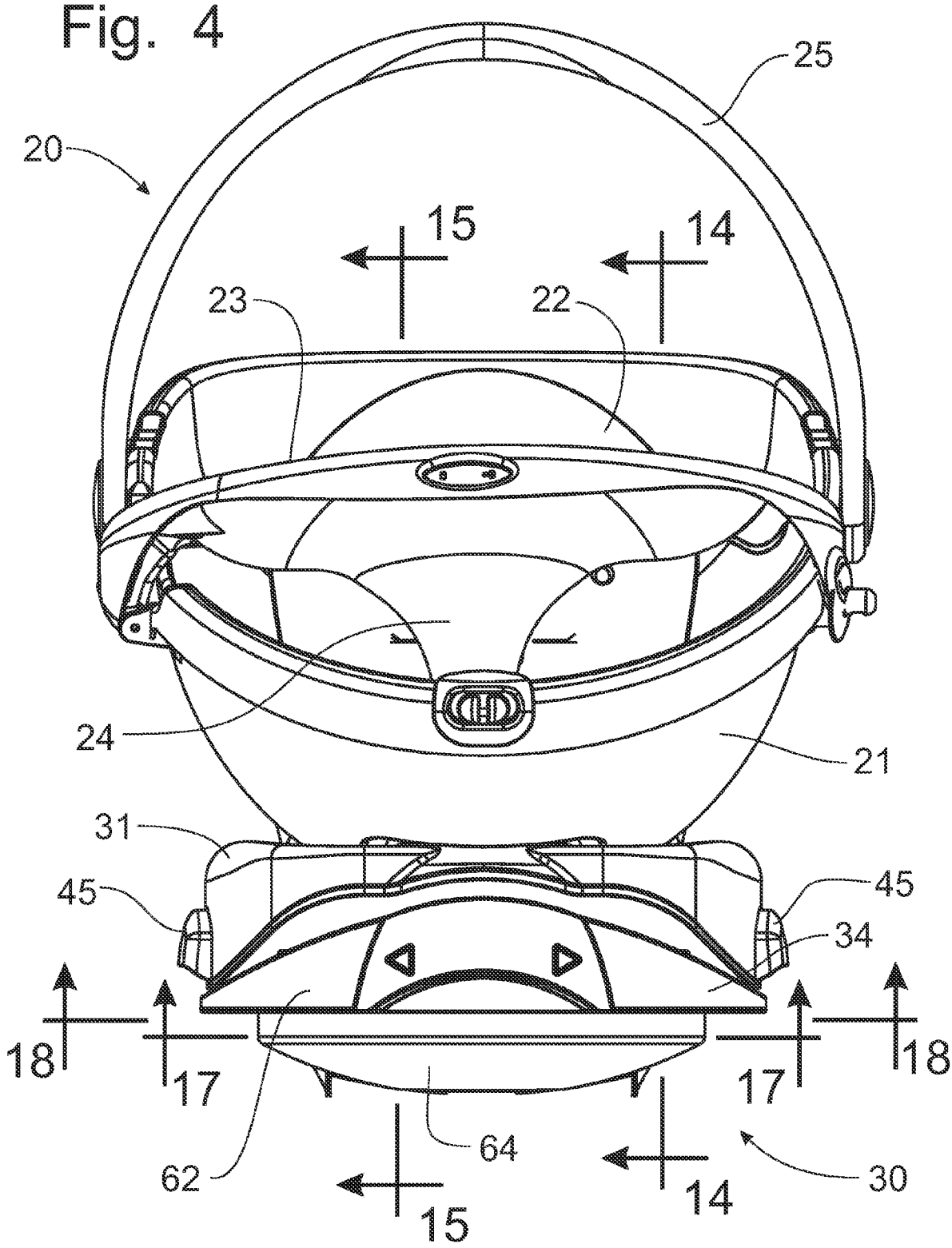
FIG. 4 is a front elevational view of the seat carrier mounted on the base member with the hanger tubes and support frame of the infant swing shown in FIG. 2 being broken away for purposes of clarity.
Figure 5:
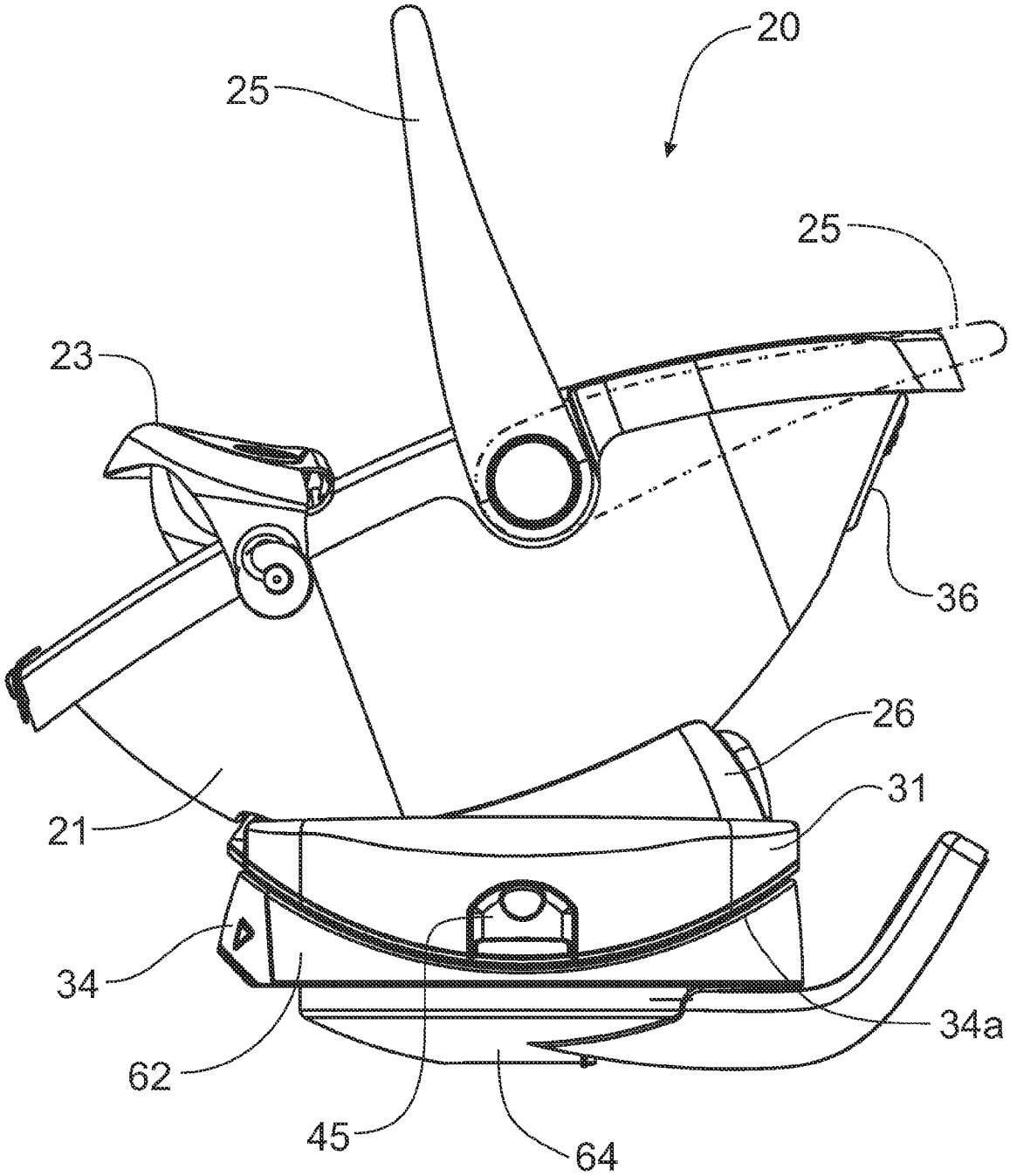
FIG. 5 is a left side elevational view of the seat carrier and base member shown in FIG. 4, the folded position of the carrier handle being shown in phantom.
Figure 6:
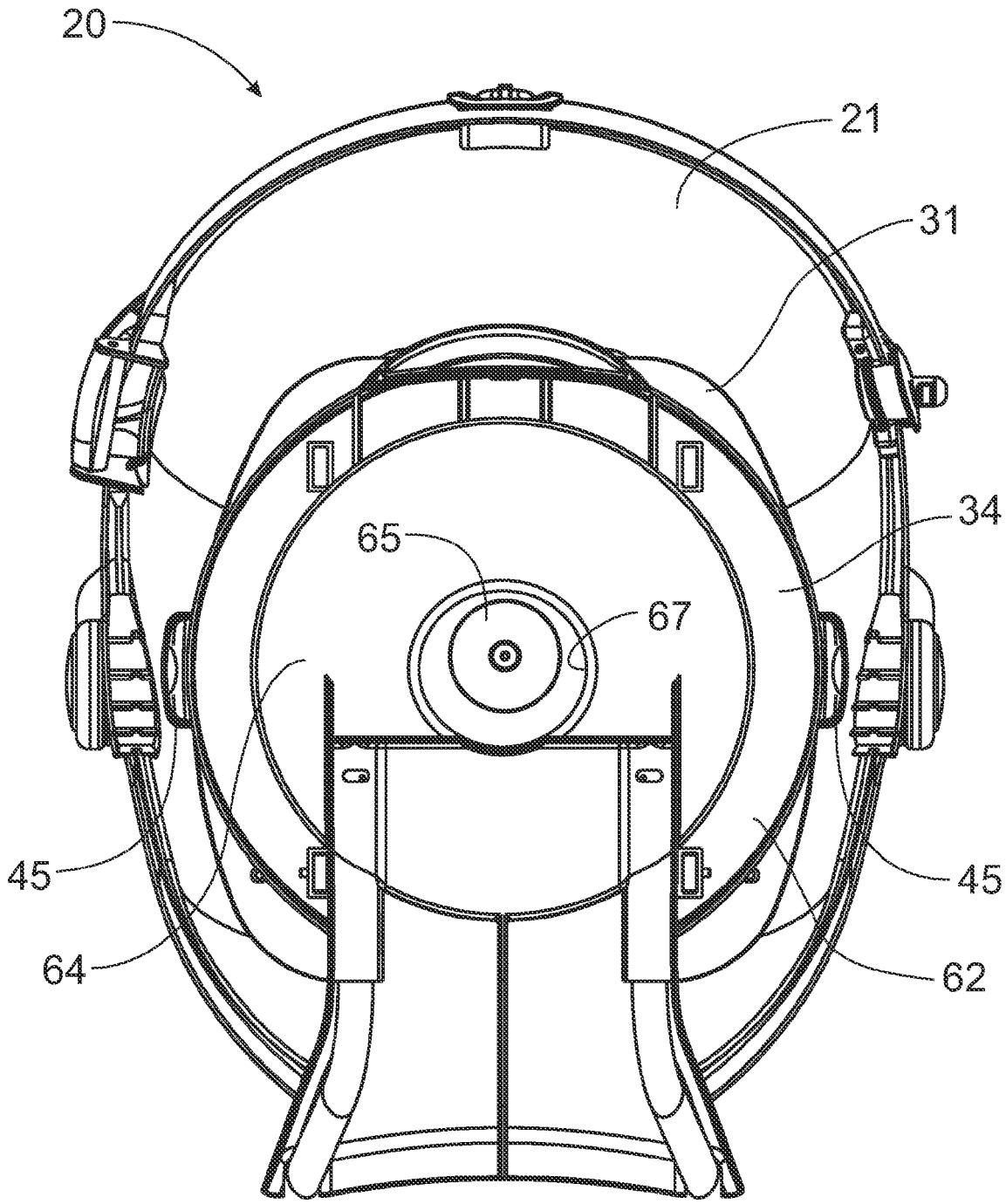
FIG. 6 is a bottom plan view of the seat carrier and base member shown in FIGS. 4 and 5.
Figure 7:
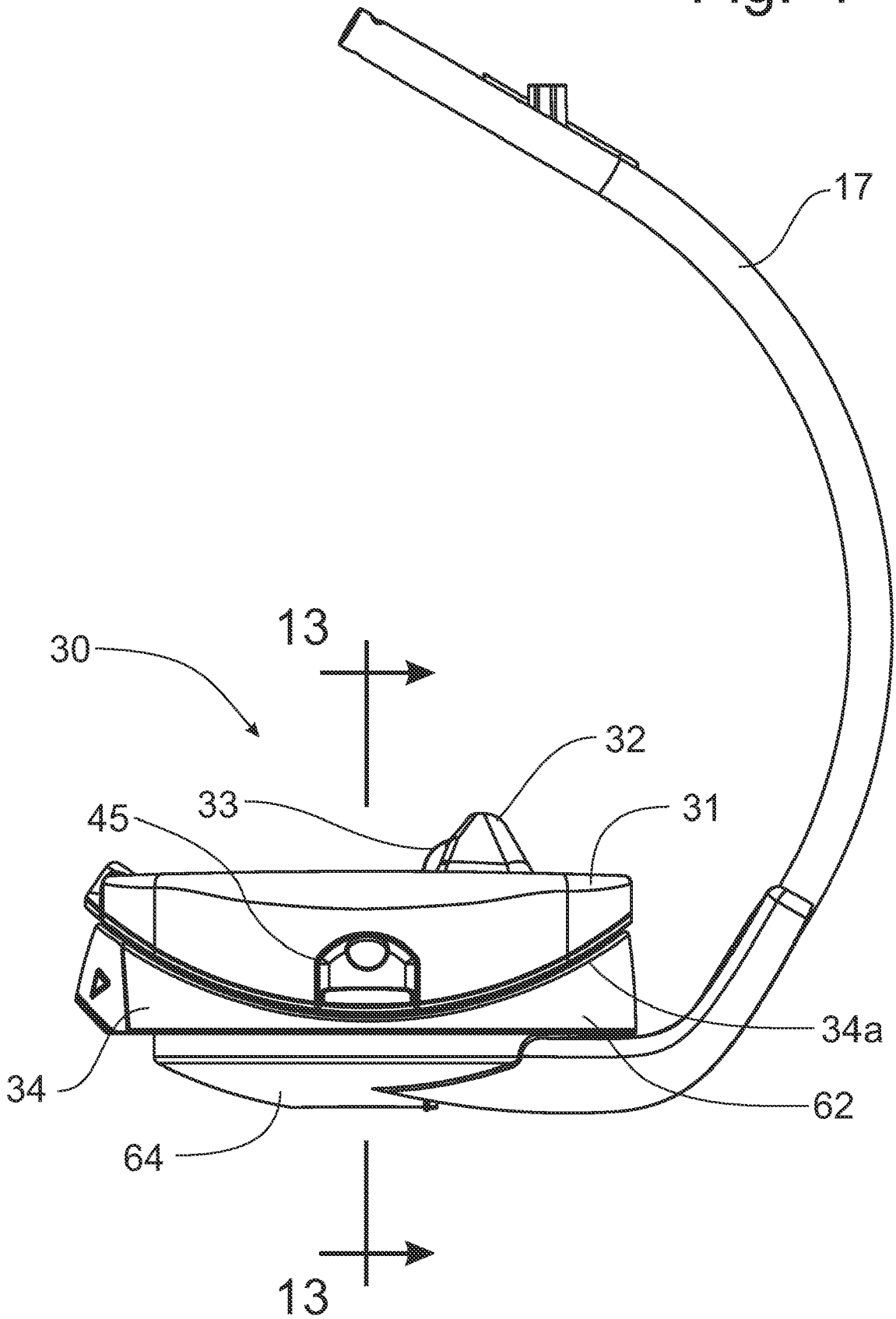
FIG. 7 is a left side elevational view of the base member supported on the hanger tubes.
Figure 17:
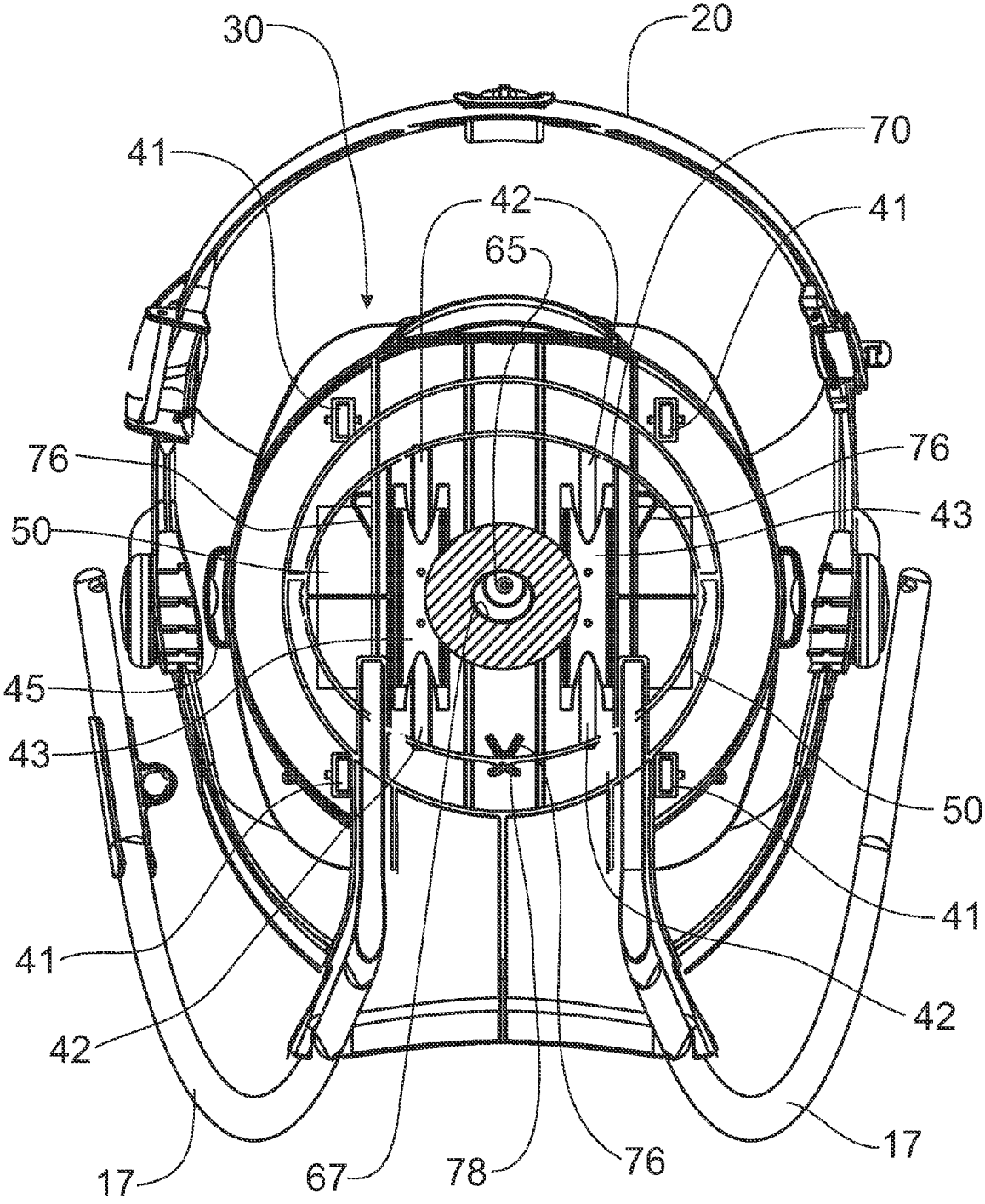
FIG. 17 is a cross-sectional view of the base member taken along lines 17-17 of FIG. 4 to show the base receiver retainer forming part of the swivel mechanism and the underside of the recline mechanism.
Figure 18:
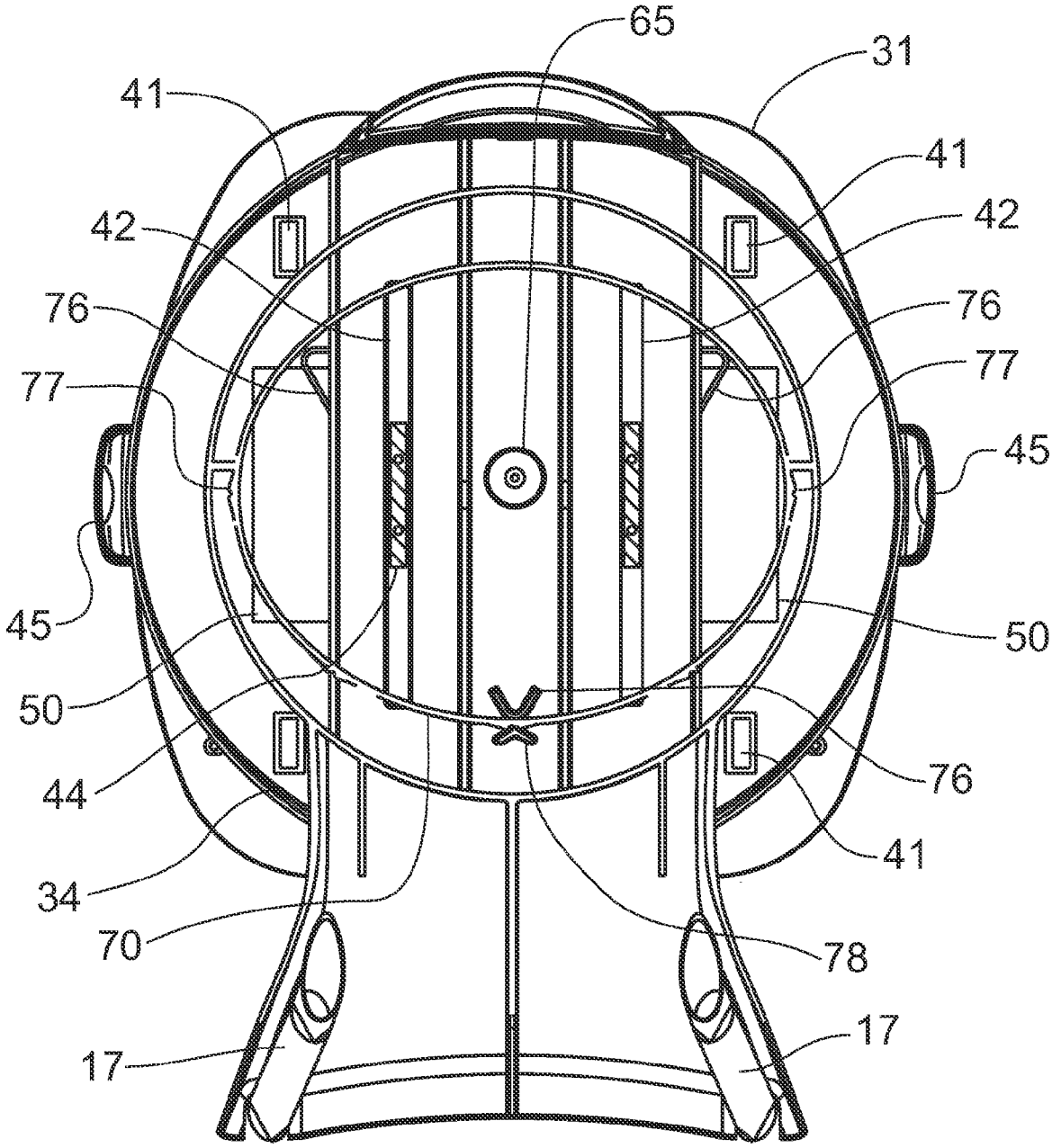
FIG. 18 is a cross-sectional view of the base member taken along lines 18-18 of FIG. 4, which is similar to FIG. 17, but taken above the slide retainers through the mounting tabs just below the upper face of the upper part of the fixed base member to depict the swivel mechanism with the seat carrier being in the back-and-forth swing configuration as shown in FIG. 4.
Figure 19:
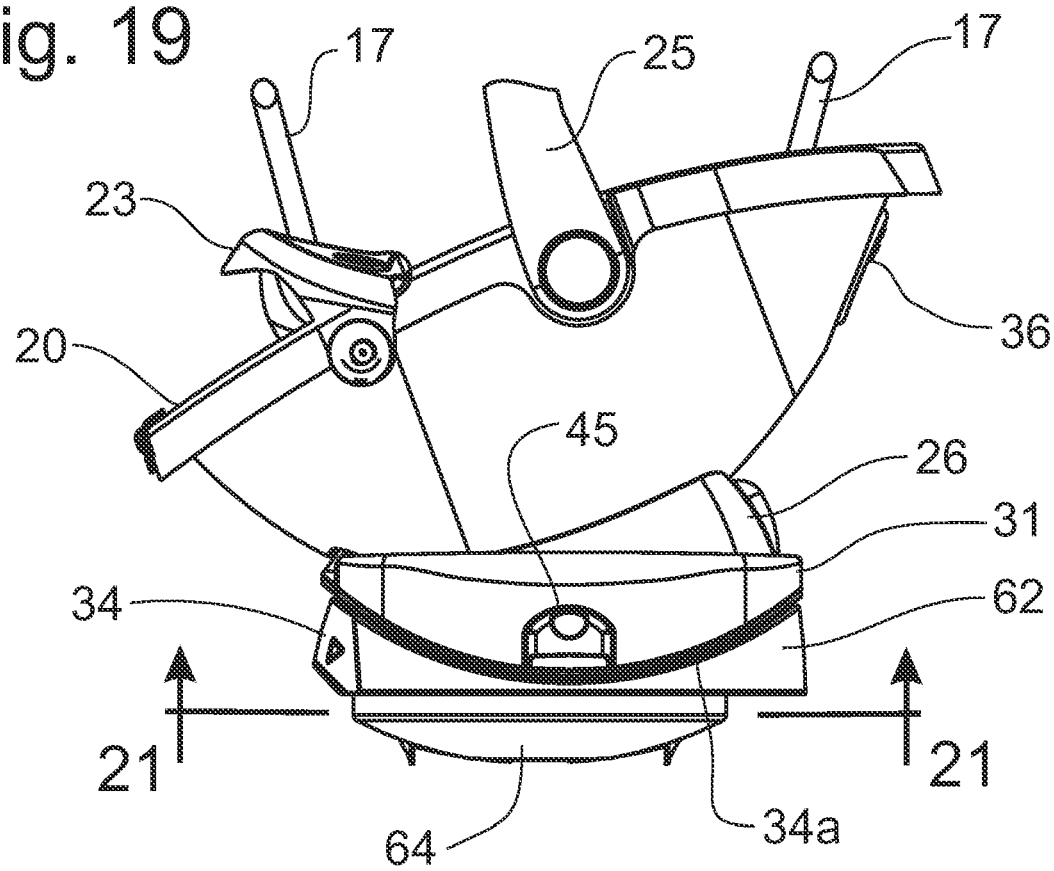
FIG. 19 is a front elevational view of the seat carrier mounted on the base member with the seat oriented in a sideways swing configuration with the seat carrier turned to the left.
Figure 20:
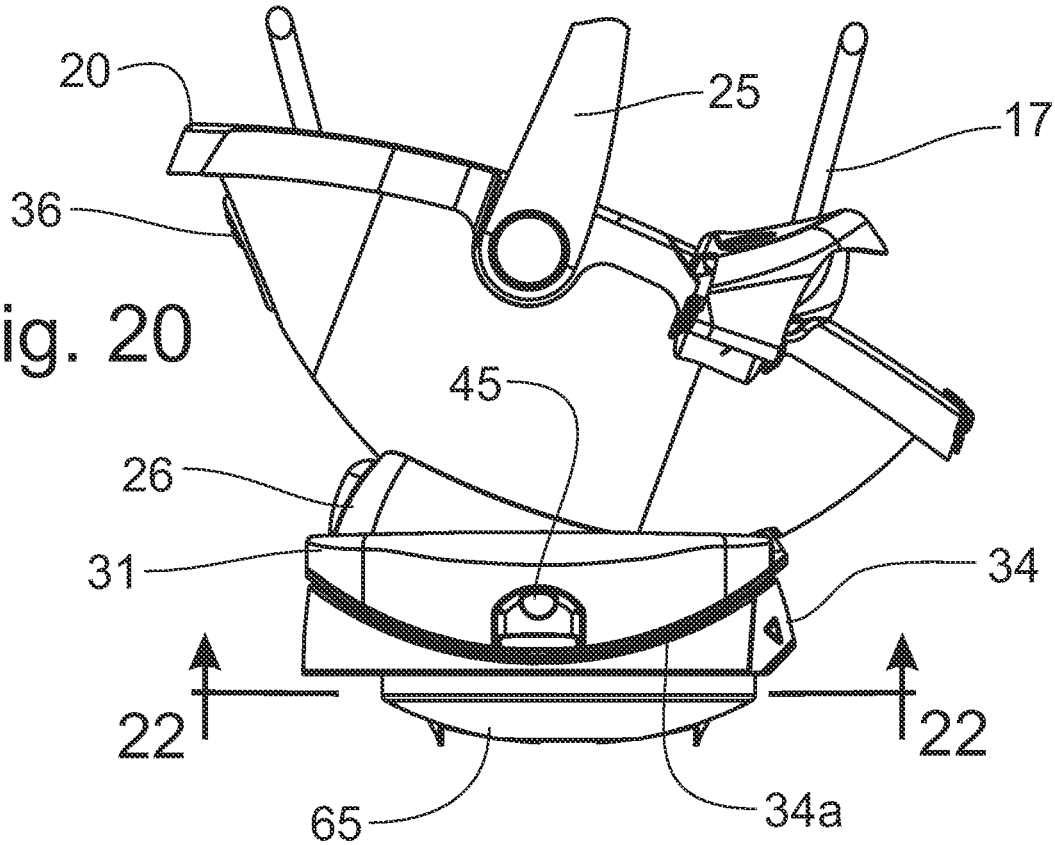
FIG. 20 is a front elevational view of the seat carrier mounted on the base member with the seat oriented in a sideways swing configuration with the seat carrier turned to the right.
Figure 21:
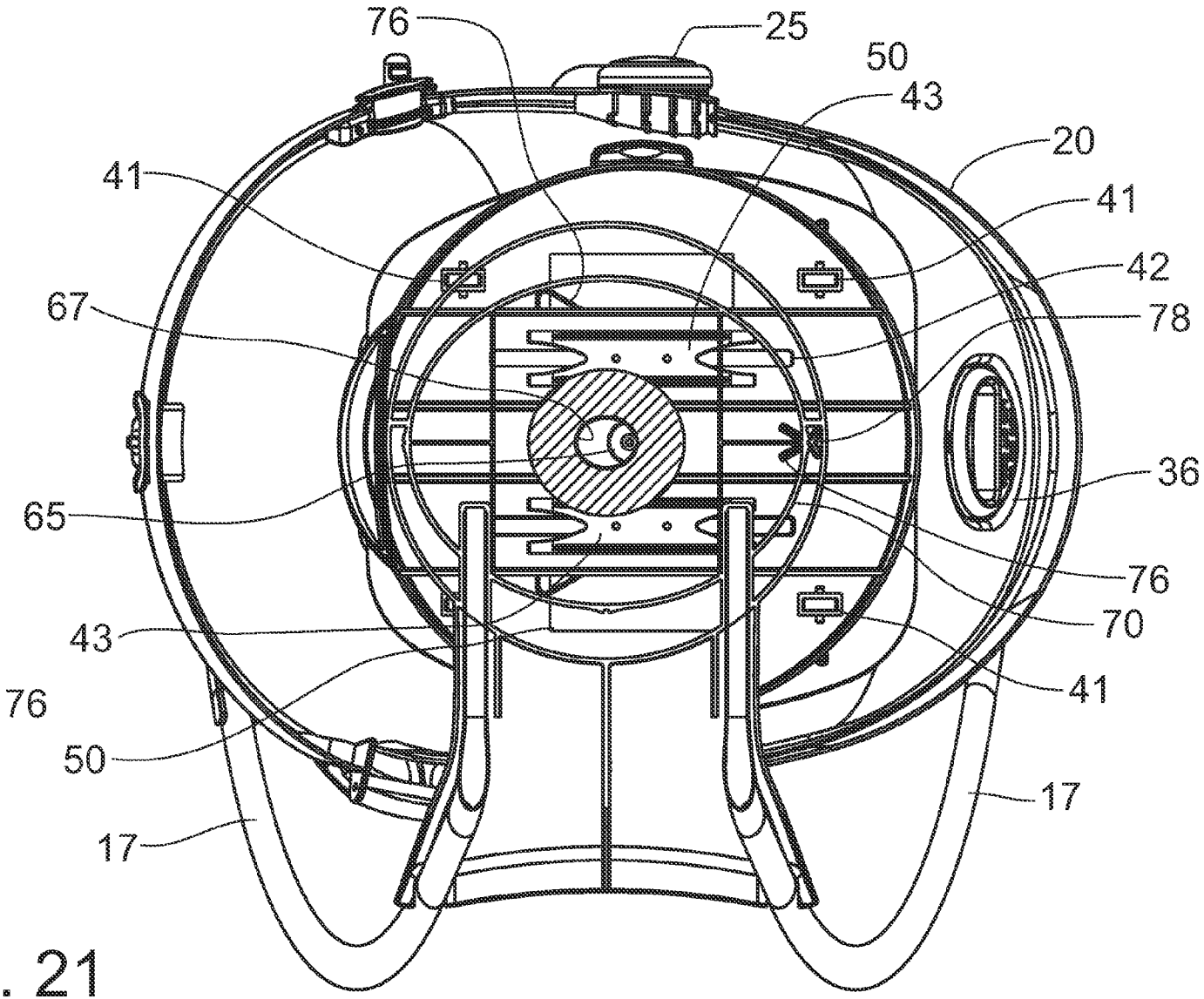
FIG. 21 is a cross-sectional view similar to that of FIG. 17, but taken along lines 21-21 in FIG. 19 to show the orientation of the rotating mechanism within the base retainer and the lateral shifting of the seat relative to the base member with the seat carrier turned to the right.
Figure 22:
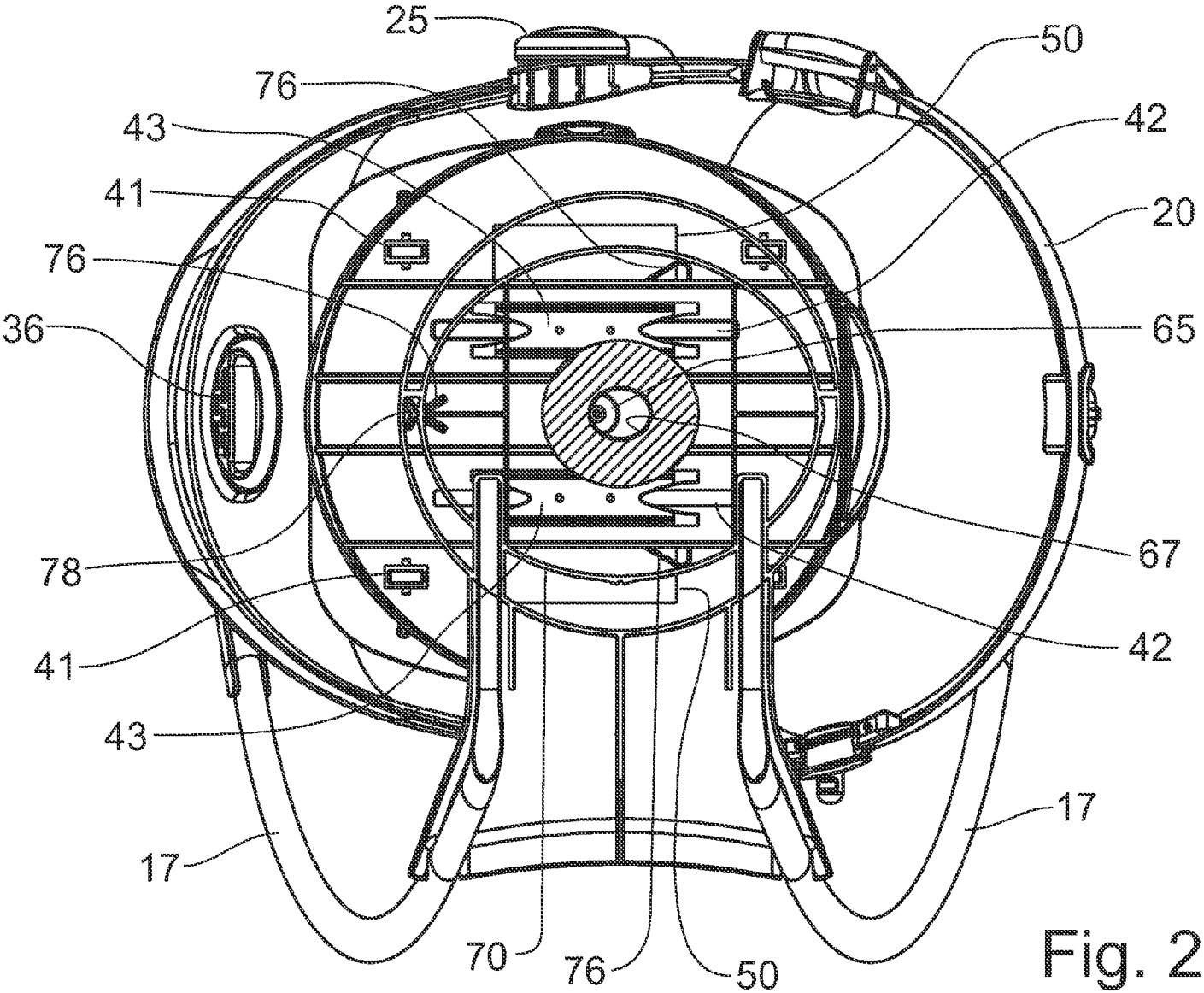
FIG. 22 is a cross-sectional view similar to that of FIG. 21, but taken along lines 22-22 in FIG. 20 to show the orientation of the rotating mechanism within the base retainer and the lateral shifting of the seat relative to the base member with the seat carrier turned to the right.

The swivel mechanism 60 is also carried within the base member 30 and is best seen in FIGS. 17-25. The swivel mechanism 60 is operable to convert the swing 10 from a back-and-forth swing configuration, as viewed by the occupant of the seat carrier 20, which is best seen in FIGS. 1 and 2, to a sideways swing configuration, which is best seen in FIGS. 19 and 20. Preferably, the swivel mechanism 60 is capable of turning the seat carrier 20 with respect to the base member 30 in either direction relative to the front-facing orientation, as is best seen in a comparison of the orientation of the seat carrier 20 in FIGS. 19 and 20. With respect to the recline mechanism 40 described in detail above, the recline mechanism 40 is operable in any of the three orientations of the seat carrier 20.

The base shell 34 is formed in two parts, an upper part 62 that includes the face 63 and a lower part 64 that is fixed to the hangers 17. The upper part 62 of the base shell 34 is secured to the top plate 31 through the slide retainers 43 so that the upper part 62 can rotate in a generally horizontal plane with the top plate 31 that is connected to the seat carrier 20 through the latching member 33. The lower part 64 of the base member 30 is connected to the upper part 62 through a connector hub 65 that is received within an oval-shaped socket 67 in the bottom of the lower part 64, as is best seen in FIGS. 6, 13 and 21-25. The connector hub 65 serves to provide a loose connection between the upper and lower parts 62, 64 without establishing a fixed vertical pivot axis. The oval socket 67 provides ample room for the translation of the connector hub 65 in conjunction with the movement of the upper part 62, as will be described in greater detail below.

Figure 23:
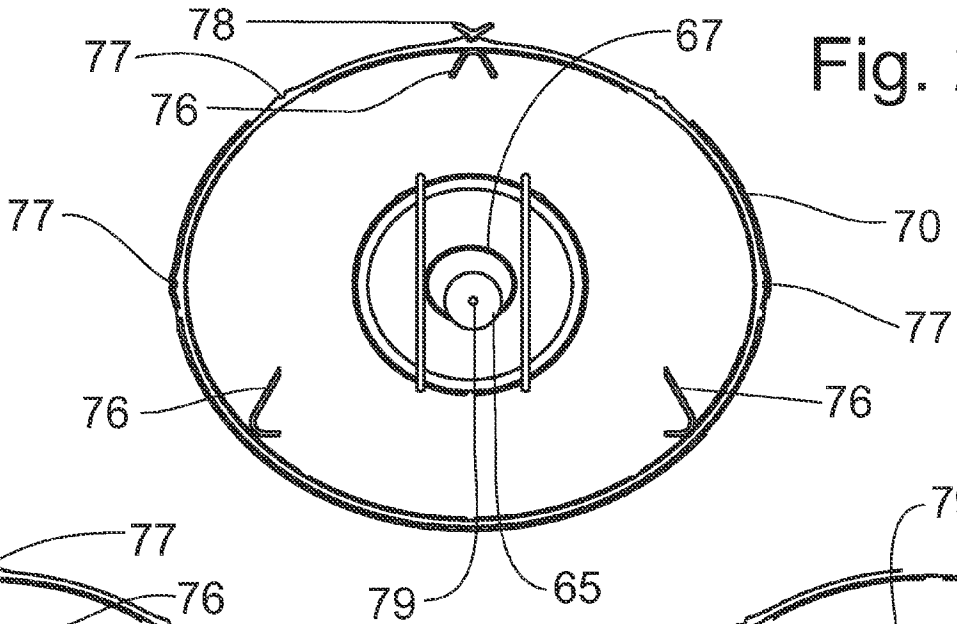
FIG. 23 is a partial cross-sectional view of the base member to provide a schematic representation of the orientation of the triangular follower apparatus within the elliptical retainer ring with the seat carrier positioned in the back-and-forth swing configuration.
Figure 25:
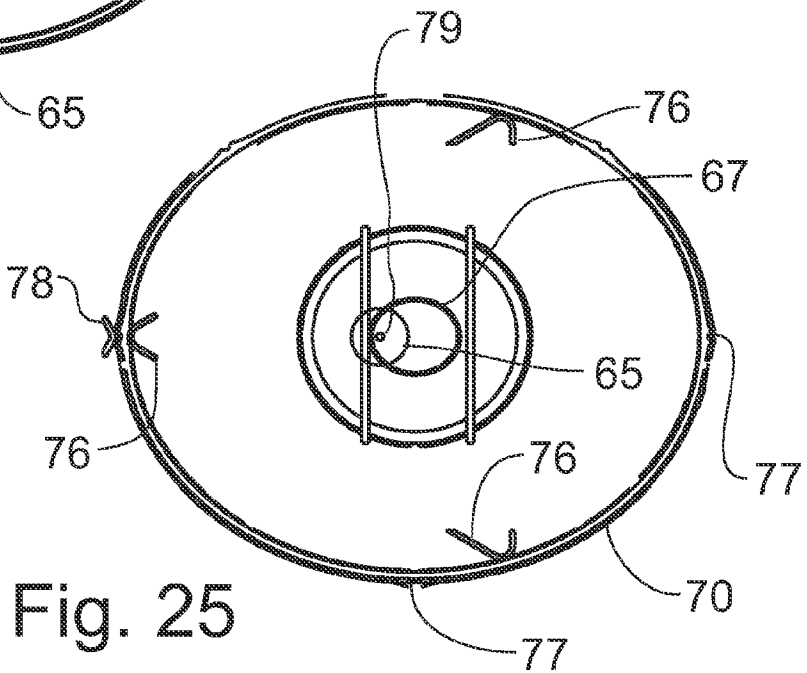
FIG. 25 is a partial cross-sectional view of the base member similar to that of FIG. 24, but schematically showing the relationship of the triangular follower apparatus relative to the elliptical retainer ring with the seat carrier turn sideways to the right.
Figure 24:
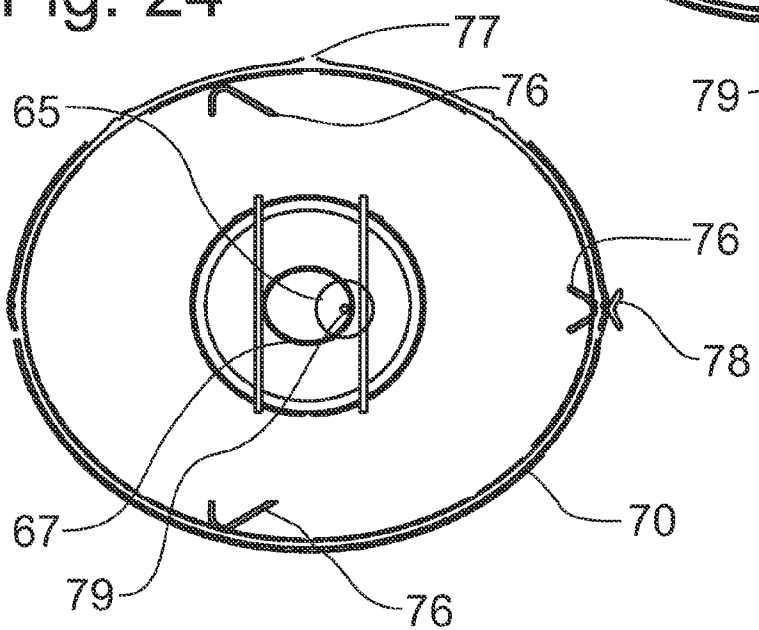
FIG. 24 is a partial cross-sectional view of the base member similar to that of FIG. 23, but schematically showing the relationship of the triangular follower apparatus relative to the elliptical retainer ring with the seat carrier turn sideways to the left.

The lower part 64 is provided with an elliptical retainer ring 70, best seen in FIGS. 17 and 18, that defines an upright wall to contain a triangular follower apparatus 75 that is formed as part of the upper part 62 placed into engagement with the retainer 70. The triangular follower apparatus 75 is defined by three contact points 76 that are spaced to engage the inside of the elliptical retainer ring 70, as is schematically depicted in FIGS. 23-25. A detent retainer 78 is located opposite the central contact point 76 to engage a detent indentation 77, as will be described in greater detail below, with the elliptical retainer ring 70 passing between the detent retainer 78 and the opposing contact point 76.

The center of gravity for the seat carrier 20 is preferably maintained at or proximate to the longitudinal center line of the swing 10. When the seat in a fixed pivot swivel mechanism is rotated from the back-and-forth swing orientation to the sideway swing orientation, the center of gravity of the seat will shift laterally. To compensate for the lateral shift in the center of gravity, the seat 20 incorporating the principles of the instant invention shifts laterally, as is represented in FIGS. 23-25, to keep the center of gravity of the seat carrier 20 and the occupant therein closer to the longitudinal centerline of the swing 10 than can be obtained by swiveling the seat carrier 20 about a fixed vertical pivot axis, unless the center of gravity is aligned with the pivot axis. This shifting of the seat structure 20 also serves to maintain the center of gravity at the correct location relative to the swing mechanism. The lateral shifting of the seat carrier 20 can be seen in a comparison of FIGS. 23-25, particularly looking at the offset at the sides of the upper part 62 relative to the lower part 64 and the shifting of the center 79 of the connector hub 65. This lateral shifting of the seat carrier 20 also shifts the seat geometry to the left or right in order to better fit the seat within the swing frame structure and to provide improved clearance of the seat carrier 20 with respect to the support frame 12. The connector hub 65 provides the mechanical connection between the upper and lower parts 62, 64 and moves laterally within the oval socket 67 in conjunction with the lateral shifting of the seat carrier 20 as the seat carrier 20 is rotated from one configuration to another.

The swivel mechanism 60 does not require a locking apparatus to secure the seat carrier 20 in the selected swing configuration, as the weight of the seat carrier and the occupant thereof are sufficient to maintain the seat carrier 20 in the selected swing configuration. A detent could be utilized to provide some resistance to the movement of the seat carrier 20 from one swing configuration to another. The detent can take the form of an indentation 77 in the outer surface of the elliptical retainer ring 70 that would be engaged by a detent retainer point 78 positioned in opposition to one of the contact points 76. By placing a detent indentation 77 at each location of the detent retainer point 78 when the seat carrier 20 is located in a particular swing configuration, the detent point 78 will engage the indentation 77 and require an application of some rotational force to move the detent retainer point 78 out of the corresponding indentation 77 and free the triangular follower apparatus 75 for movement within the elliptical retainer 70. As can be seen in FIGS. 23-25, an intermediate detent indentation 77 can be located between the orthogonal swing orientations to provide an opportunity to position the seat carrier 20 at an intermediate position (not shown).

In operation, the seat carrier 20 can be transferred from one application, such as a car seat, with the infant asleep therein and placed onto the base member 30 without waking the infant due to moving the infant from one seat to another. The seat carrier 20 automatically snaps into place by the spring-loaded latch member 33 deflecting due to engagement with the mounting structure 26 and locking into the latch opening 28 in the receptacle 27. By depressing the recline actuation handle 45 from either side of the seat carrier 20, the seat carrier 20 can be reclined to a desired orientation, whereupon the recline actuation handle 45 is released to allow the centering springs 48 to move the protrusions 49 into an interfering position with respect to the blocks 52 in the locking channels 50, the protrusions 49 passing into transverse grooves 54 between corresponding blocks 52.

In the event the caregiver decides to change the swing orientation of the seat carrier 20, the caregiver simply grasps the seat carrier 20 and applies a rotational force to rotate the seat carrier 20 connected to the top plate 31, which is connected to the upper part 62 of the base shell 34, relative to the lower part 64 of the base shell 34. The swivel mechanism 60 provides a simple and effective operation to change the swing configuration of the seat carrier 20. Furthermore, the non-pivot axis swivel mechanism 60, utilizing a triangular follower apparatus 75 contained within an elliptical retainer 70, affects a lateral shifting of the seat carrier 20 when the seat carrier 20 is moved from a back-and-forth swing configuration to a sideways swing configuration to keep the center of gravity of the seat carrier 20 and the occupant thereof close to the longitudinal centerline of the swing 10.

With the recline mechanism 40 being housed within the base member 30, the recline mechanism 40 is equally operable to provide a one-hand recline operation irrespective of the swing configuration selected through operation of the swivel mechanism 60. The seat carrier 20 can be easily detached from the base member 30 no matter which swing configuration has been selected through the swivel mechanism 60, simply by pulling on the external pull member 36 to deflect the latch member 33 out of engagement with the latch opening 28, thus freeing the seat carrier 20 to be lifted vertically off of the base member 30.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

Having thus described the invention, What is claimed is:

1. A child swing comprising:

a frame assembly operable to induce a reciprocal movement relative to said frame assembly;

a seat assembly supported from said frame assembly for movement in a reciprocal manner relative to said frame assembly; and a recline actuator handle mounted on said seat assembly to control a positioning of said seat assembly into a selected recline position, said recline actuator handle including at least one protrusion extending downwardly into engagement with a locking apparatus formed in said seat assembly, said locking apparatus including:

a pair of laterally spaced longitudinally extending passageways;

a plurality of blocks spaced longitudinally between said passageways; and a plurality transverse grooves extending respectively between adjacent said blocks and interconnecting said passageways, said at least one protrusion being selectively located within one of said transverse grooves to place said seat carrier in said selected recline position when said recline actuation handle is in said central recline locking position, said at least one protrusion being in one of said passageways when said recline actuation handle is moved to either side of said central recline locking position.

2. The child swing of claim 1 wherein said base member assembly includes a base shell secured to said hanger apparatus and a top plate movably mounted on said base shell, said top plate being engaged with said seat carrier and being movable relative to said base shell to place said seat carrier in said selected recline position.

3. The child swing of claim 1 wherein said recline actuation handle includes a center chamber receiving a center post formed in said top plate, said center chamber having a pair of biasing springs positioned on opposing sides of said center post to bias said recline actuation handle into said central recline locking position.

4. The child swing of claim 1 wherein said seat assembly includes a base member and a seat carrier detachably mounted to said base member, said child swing further comprising a swivel mechanism housed within said base member assembly to permit said seat carrier to be oriented in a selected swing configuration.

5. The child swing of claim 4 wherein said base member assembly includes a base shell and a top plate movably mounted on said base shell, said top plate being engaged with said seat carrier and being movable relative to said base shell to place said seat carrier in said selected recline position, said base shell including an upper part connected to said top plate to be movable therewith about a generally horizontal plane and a lower part connected to said upper part through a connector hub permitting rotation of said upper part relative to said lower part.

6. The child swing of claim 4 wherein said swivel mechanism comprises:

an elliptically shaped retainer ring formed on said lower part; and a triangular follower apparatus formed on said upper part, said triangular follower apparatus affecting lateral movement of said seat carrier when said follower apparatus follows said elliptically shaped retainer ring in conjunction with the rotation of said seat carrier into a different swing configuration.

7. The child swing of claim 6 wherein said triangular follower apparatus comprises a trio a contact points arranged in a triangular configuration in engagement with said elliptically shaped retainer ring.

8. The child swing of claim 6 wherein a connector hub is positioned within an oval-shaped socket on said lower part of said base shell, said connector hub moving laterally within said socket when said seat carrier is moved from one swing configuration to another swing configuration.

9. A child swing having a frame assembly operable to induce a reciprocal movement into a seat assembly for movement relative to said frame assembly, comprising:

said seat assembly including a seat member supported on a base member assembly having an upper part connected to said seat member, so that said seat member is movable with said upper part, and a lower part connected to said upper part in a manner to permit rotational movement of said upper part and said connected seat member relative to said lower part; and a swivel mechanism disposed between said upper and lower parts of said base member assembly solely for causing movement of said upper part of said base member assembly relative to said lower part of said base member assembly within a horizontal plane to move said seat member between a back-and-forth swing configuration and a sideways swing configuration, said swivel mechanism being operable to cause said upper part of said base member to slide laterally in a non-axial manner relative to said lower part of said base member when rotated between said back-and-forth swing configuration and said sideways swing configuration.

10. The child swing of claim 9 wherein said swivel mechanism comprises:

an elliptically shaped retainer ring formed on said lower part; and a triangular follower apparatus formed on said upper part, said triangular follower apparatus affecting said lateral movement of said seat member when said follower apparatus follows said elliptically shaped retainer ring in conjunction with the rotation of said seat member between said back-and-forth swing configuration and said sideways swing configuration.

11. The child swing of claim 10 wherein said triangular follower apparatus comprises a trio a contact points arranged in a triangular configuration in engagement with said elliptically shaped retainer ring.

12. The child swing of claim 9 wherein said lower part is connected to said upper part through a connector hub positioned within an oval-shaped socket on an underside surface of said lower part of said base shell, said connector hub moving laterally within said socket when said seat member is moved between said back-and-forth swing configuration and said sideways swing configuration.

13. The child swing of claim 9 further comprising:

a recline mechanism housed within said base member assembly to permit said seat member to be placed into a selected recline position.

14. The child swing of claim 13 wherein said seat member is supported on said upper part for movement along an arcuate interface defining a track along which the seat member can move relative to said upper part, said recline mechanism controlling the movement of said seat member along said arcuate track.

15. The child swing of claim 14 wherein said base member assembly further includes a top plate on which said seat member is mounted, said top plate being movable along said arcuate track to affect a positioning of said seat member in a selected reclined position, said recline mechanism including a transversely oriented recline actuator handle that projects out of said top plate, said recline actuator handle being spring biased to a central position and being linearly movable to either side of said central position.

16. The child swing of claim 15 wherein said recline actuation handle includes:

a center chamber operable to receive a center post formed on said top plate, said center chamber housing a pair of biasing springs on opposing sides of said center post to bias said recline actuation handle into said central position; and a pair of laterally spaced protrusions extending downwardly into engagement with a locking apparatus, the movement of said recline actuator handle to either side of said central position affecting the release of said protrusions from said locking apparatus.

17. A child swing having a frame assembly operable to induce a reciprocal movement into a seat assembly for movement relative to said frame assembly, comprising:

said seat assembly having a top plate and a base shell meeting said top plate along an arcuate interface defining an arcuate track along which the top plate can move relative to said base shell; and a recline actuator handle housed within said seat assembly to control the movement of said top plate relative to said base shell along said arcuate track, said recline actuation handle including:

a center chamber operable to receive a center post formed on said top plate, said center chamber housing a pair of biasing springs on opposing sides of said center post to bias said recline actuation handle into a central position; and a pair of laterally spaced protrusions extending downwardly into engagement with a locking apparatus on said base shell, the movement of said recline actuator handle to either side of said central position affecting the release of said protrusions from said locking apparatus, said locking apparatus including:

a pair of laterally spaced longitudinally extending passageways;

a plurality of blocks spaced longitudinally between said passageways; and a transverse groove extending between adjacent said blocks and interconnecting said passageways, said protrusions being located within said transverse grooves when said recline actuation handle is in said central position, said protrusions being in one of said passageways when said recline actuation handle is moved to either side of said central position.

18. The child swing of claim 17 wherein said actuator handle projects out of said top plate.

19. The child swing of claim 18 wherein said base shell includes an upper part connected to said top plate to permit rotational movement therewith in a horizontal plane, and a lower part connected to said upper part to permit said rotational movement relative to said lower part, said child swing further comprising:

a swivel mechanism disposed between said upper and lower parts of said base shell, said swivel member being selectively operable to position said seat assembly in a back-and-forth swing configuration and in a sideways swing configuration, said swivel mechanism being operable to cause said seat assembly to shift laterally when rotated between said back-and-forth swing configuration and said sideways swing configuration.

20. The child swing of claim 19 wherein said swivel mechanism comprises:

an elliptically shaped retainer ring formed on said lower part; and a trio a contact points arranged in a triangular configuration in engagement with said elliptically shaped retainer ring to define a triangular follower apparatus causing said lateral movement of said seat assembly when said follower apparatus follows said elliptically shaped retainer ring in conjunction with the rotation of said seat assembly.

21. The child swing of claim 19 wherein said top plate is formed with an upwardly extending mounting protrusion, said seat assembly being formed with a mounting structure including a receptacle configured to receive said mounting protrusion, said mounting protrusion including a spring-loaded latch member positioned to engage a latch opening in said mounting structure, said seat assembly incorporating a latch actuation mechanism selectively operable to affect a retraction of said latch member from said latch opening and allow said seat assembly to be separated from said frame assembly.

22. A child swing having a frame assembly operable to induce a reciprocal movement into a seat assembly for movement relative to said frame assembly, comprising:

said seat assembly including a seat member supported on a base member by a connector hub; and a swivel mechanism disposed between said seat member and said base member solely for causing movement of said seat member relative to said base member within a horizontal plane to move said seat member between a back-and-forth swing configuration and a sideways swing configuration, said swivel mechanism being operable to cause said connector hub to slide laterally relative to said base member as said seat member is being moved between said back-and-forth swing configuration and said sideways swing configuration, said connector hub being rotatable in a non-axial manner with said seat member within a non-circular retainer ring on said base member to move between said back-and-forth and said sideways swing configurations.

23. The child swing of claim 22 wherein said retainer ring is elliptical in shape and said connector hub forming part of said swivel mechanism comprises:

a triangular follower apparatus connected to said seat member for rotational movement therewith, said triangular follower apparatus affecting said lateral movement of said seat member when said follower apparatus follows said elliptical retainer ring in conjunction with the rotation of said seat member between said back-and-forth swing configuration and said sideways swing configuration.

24. The child swing of claim 23 wherein said triangular follower apparatus comprises a trio a contact points arranged in a triangular configuration in engagement with said elliptical retainer ring.

25. The child swing of claim 23 wherein said base member includes an upper part connected to said seat member for rotational movement therewith and a lower part connected to said upper part in a manner to permit rotational movement of said upper part and said connected seat member relative to said lower part, said triangular follower apparatus being formed on said upper part.

26. A child swing having a frame assembly operable to induce a reciprocal movement into a seat assembly for movement relative to said frame assembly, comprising:

said seat assembly including a seat member supported on a base member having an upper part connected to said seat member so that said seat member is movable with said upper part, and a lower part connected to said upper part through a connector hub to permit rotational movement of said upper part and said connected seat member relative to said lower part; and a swivel mechanism disposed between said upper and lower parts of said base member, said swivel member being selectively operable to position said seat member in a back-and-forth swing configuration and in a sideways swing configuration, said swivel mechanism being operable to cause said connector hub to shift laterally relative to said lower part when said upper part and said seat member is rotated between said back-and-forth swing configuration and said sideways swing configuration.

27. The child swing of claim 9 wherein said lower part of said base member has a non-circular socket to allow the connector hub to move within said socket.

* * * * *